US009651287B2

(12) United States Patent
Morimoto et al.

(10) Patent No.: US 9,651,287 B2
(45) Date of Patent: May 16, 2017

(54) AIR-CONDITIONING APPARATUS

(75) Inventors: Hiroyuki Morimoto, Tokyo (JP); Koji Yamashita, Tokyo (JP); Yoshihiro Sumida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 277 days.

(21) Appl. No.: 14/128,033

(22) PCT Filed: Sep. 30, 2011

(86) PCT No.: PCT/JP2011/005527
§ 371 (c)(1),
(2), (4) Date: Dec. 20, 2013

(87) PCT Pub. No.: WO2013/046279
PCT Pub. Date: Apr. 4, 2013

(65) Prior Publication Data
US 2014/0130528 A1 May 15, 2014

(51) Int. Cl.
*G01K 13/00* (2006.01)
*F25B 49/02* (2006.01)
(Continued)

(52) U.S. Cl.
CPC ..... *F25B 49/02* (2013.01); *F25B 9/006* (2013.01); *F25B 13/00* (2013.01); *F25B 49/005* (2013.01);
(Continued)

(58) Field of Classification Search
CPC ... F25B 49/02; F25B 49/005; F25B 2313/006
See application file for complete search history.

(56) References Cited

U.S. PATENT DOCUMENTS 5,987,907 A * 11/1999 Morimoto ..... F25B 9/006 62/212
5,996,358 A * 12/1999 Sumida ..... C09K 5/045 62/114
(Continued)

FOREIGN PATENT DOCUMENTS

JP 08-075280 A 3/1996
JP 09-014770 A 1/1997
(Continued)

OTHER PUBLICATIONS

Hideki et al., Refrigeration Device and Refrigerant Filling Method, Oct. 1, 2009, JP2009222356A, Whole Document.*
(Continued)

*Primary Examiner* — Larry Furdge
(74) *Attorney, Agent, or Firm* — Posz Law Group, PLC

(57) ABSTRACT

A computing device calculates a quality of a refrigerant flowing out of an expansion device on the basis of an inlet liquid enthalpy calculated on the basis of a temperature of the refrigerant flowing into the expansion device, and a saturated gas enthalpy and a saturated liquid enthalpy calculated on the basis of a temperature or pressure of the refrigerant flowing out of the expansion device; calculates a liquid-phase concentration and a gas-phase concentration of the refrigerant flowing out of the expansion device on the basis of the temperature and pressure of the refrigerant flowing out of the expansion device; and calculates a composition of the refrigerant circulating in a refrigeration cycle on the basis of the calculated quality, liquid-phase concentration, and gas-phase concentration.

9 Claims, 13 Drawing Sheets

(51) Int. Cl.

| | |
|---|---|
| ***F25B 9/00*** | (2006.01) |
| ***F25B 13/00*** | (2006.01) |
| ***F25B 49/00*** | (2006.01) |
| *F25B 25/00* | (2006.01) |

(52) U.S. Cl.

CPC ..... *F25B 25/005* (2013.01); *F25B 2313/006* (2013.01); *F25B 2313/0231* (2013.01); *F25B 2313/0272* (2013.01); *F25B 2313/02732* (2013.01); *F25B 2313/02741* (2013.01); *F25B 2313/0311* (2013.01); *F25B 2313/0314* (2013.01); *F25B 2400/08* (2013.01); *F25B 2400/121* (2013.01); *F25B 2500/19* (2013.01); *F25B 2600/21* (2013.01)

(56) References Cited

U.S. PATENT DOCUMENTS

| | | | | |
|---|---|---|---|---|
| 6,079,217 | A * | 6/2000 | Judge | G01N 33/0049 62/102 |
| 2006/0130444 | A1 * | 6/2006 | Smith | B01D 45/16 55/345 |
| 2009/0000322 | A1 * | 1/2009 | Hatakeyama | B60H 1/3208 62/228.3 |

FOREIGN PATENT DOCUMENTS

| | | | | |
|---|---|---|---|---|
| JP | 11-063747 | A | | 3/1999 |
| JP | 2008-196829 | A | | 8/2008 |
| JP | 2009-222356 | A | | 10/2009 |
| JP | 2009222356 | A | * | 10/2009 |
| JP | WO2009133640 | A1 | * | 11/2009 |
| JP | WO2010049998 | A1 | * | 5/2010 |
| WO | 2011/030430 | A1 | | 3/2011 |

OTHER PUBLICATIONS

Koji et al., Air Conditioner and Relaying Device, May 6, 2010, WO2010049998A1, Whole Document.*

Shinichi et al., Air Conditioner, Nov. 5, 2009, WO2009133640A1, Whole Document.*

Office Action mailed, Jul. 7, 2015 in the corresponding JP patent application No. 2013-535643 (with English Translation).

Office Action mailed Dec. 2, 2014 issued in corresponding JP patent application No. 2013-535643 (and English translation).

International Search Report of the International Searching Authority mailed Dec. 27, 2011 for the corresponding international application No. PCT/JP2011/005527 (and English translation).

Extended European Search Report mailed Jun. 12, 2015 in the corresponding European Patent Application No. 11873374.0.

Office Action dated Apr. 8, 2015 issued in corresponding CN patent application No. 201180072908.8.

* cited by examiner

FIG. 12

EFFECT OF SET CIRCULATION COMPOSITION ON CALCULATED CIRCULATION COMPOSITION

| SET CIRCULATION COMPOSITION αb[wt%] | CALCULATED CIRCULATION COMPOSITION α[wt%] |
|---|---|
| 50 | 62.48 |
| 54 | 62.52 |
| 58 | 62.56 |
| 62 | 62.60 |
| 66 | 62.63 |
| 70 | 62.65 |
| 74 | 62.68 |

FIG. 13

CALCULATED R32 COMPOSITION

| NO. | TH1 | P1 | TH2 | α (TABLE) | α (DETAILED VERSION) |
|---|---|---|---|---|---|
| | [°C] | [MPa] | [°C] | [wt%] | [wt%] |
| 1 | 44.0 | 0.6 | −3.0 | 62.66 | 62.6 |
| 2 | 45.0 | 0.6 | −3.0 | 62.79 | 62.73 |
| 3 | 43.0 | 0.6 | −3.0 | 62.53 | 62.47 |
| 4 | 44.0 | 0.6 | −2.0 | 57.95 | 57.85 |
| 5 | 44.0 | 0.6 | −4.0 | 67.36 | 67.33 |
| 6 | 44.0 | 0.65 | −3.0 | 75.73 | 75.76 |
| 7 | 44.0 | 0.55 | −3.0 | 52.18 | 52.05 |

AIR-CONDITIONING APPARATUS

CROSS REFERENCE TO RELATED APPLICATION

This application is a U.S. national stage application of PCT/JP2011/005527 filed on Sep. 30, 2011, the disclosure of which is incorporated by reference.

TECHNICAL FIELD

The present invention relates to an air-conditioning apparatus applied, for example, to multi-air-conditioning apparatuses for buildings.

BACKGROUND

Air-conditioning apparatuses include one in which, like a multi-air-conditioning apparatus for buildings, a heat source (outdoor unit) is installed outside a building and an indoor unit is installed inside the building. A refrigerant that circulates in a refrigerant circuit of the air-conditioning apparatus transfers heat to (or receives heat from) air supplied to a heat exchanger of the indoor unit so as to heat or cool the air. Then, the heated or cooled air is sent to an air-conditioned space for heating or cooling the space.

Such an air-conditioning apparatus often includes a plurality of indoor units, because a building typically has a plurality of indoor spaces. In the case of a large building, a refrigerant pipe that connects the outdoor unit and each indoor unit may reach as long as 100 m. The longer the pipe that connects the outdoor unit and the indoor unit, the larger the amount of refrigerant charged into the refrigerant circuit.

An indoor unit of such a multi-air-conditioning apparatus for buildings is typically installed and used in an indoor space (e.g., office space, room, or shop) where there are people. If for some reason a refrigerant leaks from the indoor unit installed in the indoor space, since the refrigerant may be flammable or toxic depending on its type, the leakage may cause safety or health problems. Even if the refrigerant is harmless to the human body, the leakage of the refrigerant may lower the concentration of oxygen in the indoor space and negatively affect the human body.

As a solution to this, an air-conditioning apparatus may use a secondary loop method in which, for air-conditioning of a space where there are people, a primary-side loop is operated with a refrigerant and a secondary-side loop is operated with harmless water or brine.

For the prevention of global warming, there has been a demand for development of air-conditioning apparatuses that use a refrigerant with a low global warming potential (hereinafter may also be referred to as GWP). Promising low GWP refrigerants include R32, HFO1234yf, and HFO1234ze. Adopting only R32 as a refrigerant does not involve significant design changes from the current apparatus and requires only a small development load, because R32 has substantially the same physical properties as R410A which is currently most often used. However, R32 has a GWP of 675, which is a little high. On the other hand, if HFO1234yf or HFO1234ze alone is adopted as a refrigerant, the pressure of the refrigerant is low because of its small density in a low-pressure state (gas state or two-phase gas-liquid gas state), and thus the pressure loss increases. However, increasing the diameter (inside diameter) of a refrigerant pipe to reduce the pressure loss leads to a higher cost.

By using a mixture of R32 and HFO1234yf or HFO1234ze as a refrigerant, it is possible to reduce the GWP while increasing the pressure of the refrigerant. Since R32, HFO1234yf, and HFO1234ze have different boiling points, the resulting refrigerant mixture is a non-azeotropic refrigerant mixture.

It is known that in an air-conditioning apparatus using a non-azeotropic refrigerant mixture, the composition of the refrigerant charged in the apparatus is different from the composition of the refrigerant actually circulating in the refrigeration cycle. This is because the boiling points of the mixed refrigerants are different as described above. The change in refrigerant composition during circulation causes the degree of superheat or subcooling to deviate from the original value, makes it difficult to optimally control the opening degree of an expansion device and various other devices, and leads to degraded performance of the air-conditioning apparatus. To reduce such performance degradation, various refrigerating and air-conditioning apparatuses with means for detecting a refrigerant composition have been proposed (see, e.g., Patent Literatures 1 and 2).

The technique described in Patent Literature 1 includes a bypass that is connected to bypass a compressor, and a double-pipe heat exchanger and a capillary tube are connected to the bypass. A refrigerant composition is calculated on the basis of detection results of various detecting means included in the bypass and a refrigerant composition tentatively set.

Likewise the technique described in Patent Literature 1, the technique described in Patent Literature 2 includes a bypass that is connected to bypass a compressor, and a double-pipe heat exchanger and a capillary tube are connected to the bypass. A refrigerant composition is calculated on the basis of detection results of various detecting means included in the bypass and a refrigerant composition tentatively set.

PATENT LITERATURE

Patent Literature 1: Japanese Unexamined Patent Application Publication No. 8-75280 (see, e.g., page 5, FIG. 1)

Patent Literature 2: Japanese Unexamined Patent Application Publication No. 11-63747 (see, e.g., page 5, FIG. 1)

The techniques described in Patent Literatures 1 and 2 include a bypass which is connected to bypass a compressor. A double-pipe heat exchanger and a capillary tube are connected to the bypass, and a refrigerant gas is liquefied by evaporation heat of the refrigerant itself. With these techniques, the cooling and heating capacities may be degraded, because a discharge side and a suction side of the compressor are bypassed.

Also, the techniques described in Patent Literatures 1 and 2 are susceptible to external disturbances caused by outside air temperatures and the like, because of a small bypass flow. This leads to degradation in detection accuracy.

SUMMARY

An object of the present invention is to provide an air-conditioning apparatus that improves the accuracy of estimating a circulation composition while reducing degradation in performance of a refrigeration cycle.

An air-conditioning apparatus includes, a refrigeration cycle formed by connecting, with a refrigerant pipe, a compressor, a first refrigerant flow switching device, a first heat exchanger, a refrigerant passage of a second heat exchanger that exchanges heat between a refrigerant and a heat medium, an expansion device that corresponds to the second heat exchanger, and a second refrigerant flow switching device, a heat medium circuit formed by connecting, with a heat medium pipe, a heat medium passage of the second heat exchanger and a use-side heat exchanger, the heat medium circuit being configured to circulate the heat medium different from the refrigerant, first temperature detecting means, second temperature detecting means, the first temperature detecting means and the second temperature detecting means being disposed before and after one of a plurality of expansion devices, first pressure detecting means, second pressure detecting means, the first pressure detecting means and the second pressure detecting means being disposed before and after the expansion device, and a computing device configured to calculate a composition of the refrigerant circulating in the refrigeration cycle on the basis of detection results of the first temperature detecting means, the second temperature detecting means, and the first pressure detecting means or the second pressure detecting means. The computing device calculates a quality of the refrigerant flowing out of one of the expansion devices on the basis of an inlet liquid enthalpy calculated on the basis of a temperature from the first temperature detecting means, and a saturated gas enthalpy and a saturated liquid enthalpy calculated on the basis of temperature information from the second temperature detecting means and pressure information from the first pressure detecting means, calculates a liquid-phase concentration and a gas-phase concentration of the refrigerant flowing out of the expansion device on the basis of a temperature and a pressure of the refrigerant flowing out of the expansion device, and, calculates the composition of the refrigerant circulating in the refrigeration cycle on the basis of the calculated quality, liquid-phase concentration, and gas-phase concentration.

The air-conditioning apparatus according to the present invention can significantly improve the accuracy of detecting a refrigerant composition.

BRIEF DESCRIPTION OF DRAWINGS

FIG. 12 is a table for describing to what extent a refrigerant composition set in a control flow for calculating a refrigerant composition gives an error to a calculated refrigerant composition.

FIG. 13 is a table for describing to what extent various detection results in the control flow for calculating a refrigerant composition give an error to a calculated refrigerant composition.

DETAILED DESCRIPTION

Embodiment of the present invention will now be described with reference to the drawings.

Figure 1:
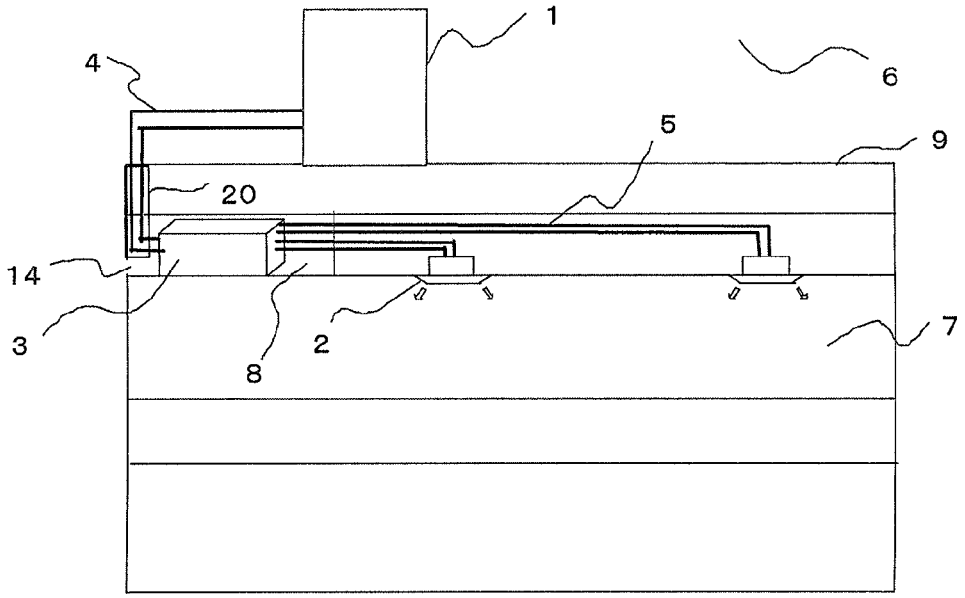
FIG. 1 is a schematic view illustrating an example of installation of an air-conditioning apparatus according to Embodiment of the present invention.

FIG. 1 is a schematic view illustrating an example of installation of an air-conditioning apparatus according to Embodiment of the present invention. The example of installation of the air-conditioning apparatus according to Embodiment will be described with reference to FIG. 1. The air-conditioning apparatus includes a refrigeration cycle for circulating a refrigerant. Each of indoor units 2 can freely select a cooling mode or a heating mode as an operation mode. Note that in the drawings including FIG. 1, size relationships among the illustrated components may be different from actual size relationships.

The air-conditioning apparatus according to Embodiment includes a refrigerant circuit A (see FIG. 2) which uses a non-azeotropic refrigerant mixture as a refrigerant, and a heat medium circuit B (see FIG. 2) which uses water or the like as a heat medium. The air-conditioning apparatus has an improved feature that calculates, with high accuracy, a composition of the refrigerant that circulates in the refrigerant circuit A.

In Embodiment, a non-azeotropic refrigerant mixture composed of R32 and HFO1234yf is used. A low-boiling refrigerant is R32 and a high-boiling refrigerant is HFO1234yf. Unless otherwise specified, a refrigerant composition in Embodiment refers to a composition of R32 which is a low-boiling refrigerant that circulates in the refrigeration cycle. A refrigerant composition of HFO1234yf, which is a high-boiling refrigerant, will not be described, as it is uniquely determined by determining the refrigerant composition of R32.

The air-conditioning apparatus according to Embodiment adopts a method (indirect method) that indirectly uses a refrigerant (heat-source-side refrigerant). Specifically, the air-conditioning apparatus transfers cooling energy or heating energy stored in the heat-source-side refrigerant to a refrigerant (hereinafter referred to as a heat medium) different from the heat-source-side refrigerant, and thereby cools or heats an air-conditioned space with the cooling energy or heating energy stored in the heat medium.

As illustrated in FIG. 1, the air-conditioning apparatus according to Embodiment includes one outdoor unit 1 serving as a heat source device, a plurality of indoor units 2, and a heat medium relay unit 3 disposed between the outdoor unit 1 and the indoor units 2. The heat medium relay unit 3 exchanges heat between the heat-source-side refrigerant and the heat medium. The outdoor unit 1 and the heat medium relay unit 3 are connected to each other by refrigerant pipes 4 for circulating the heat-source-side refrigerant. The heat medium relay unit 3 and each of the indoor units 2 are connected to each other by pipes (heat medium pipes) 5 for circulating the heat medium. Cooling energy or heating energy generated by the outdoor unit 1 is delivered via the heat medium relay unit 3 to the indoor units 2.

The outdoor unit 1 is typically placed in an outdoor space 6 which is a space (e.g., rooftop) outside a building 9. The outdoor unit 1 supplies cooling energy or heating energy via the heat medium relay unit 3 to the indoor units 2.

The indoor units 2 are each placed at a location from which cooling air or heating air can be supplied to an indoor space 7 which is a space (e.g., room) inside the building 9. The indoor units 2 supply cooling air or heating air to the indoor space 7 which is to be an air-conditioned space.

The heat medium relay unit 3 is housed in a housing separate from those for the outdoor unit 1 and the indoor units 2, and is placed at a location different from the outdoor space 6 and the indoor space 7. The heat medium relay unit 3 is connected via the refrigerant pipes 4 to the outdoor unit 1, and connected via the pipes 5 to the indoor units 2. The heat medium relay unit 3 transfers, to the indoor units 2, cooling energy or heating energy supplied from the outdoor unit 1.

As illustrated in FIG. 1, in the air-conditioning apparatus according to Embodiment, the outdoor unit 1 and the heat medium relay unit 3 are connected via two refrigerant pipes 4, and the heat medium relay unit 3 and each of indoor units 2*a* to 2*d* are connected via two pipes 5. Thus, connecting the different units (outdoor unit 1, indoor units 2, and heat medium relay unit 3) via the refrigerant pipes 4 and the pipes 5 facilitates construction of the air-conditioning apparatus according to Embodiment 1.

FIG. 1 illustrates an example where the heat medium relay unit 3 is installed in a space inside the building 9 but not in the indoor space 7. Specifically, in FIG. 1, the heat medium relay unit 3 is installed in a space above a ceiling (e.g., a space above the ceiling in the building 9, hereinafter simply referred to as a space 8). The heat medium relay unit 3 may be installed in a shared space, such as a space where there is an elevator. Although the indoor units 2 are of a ceiling cassette type in FIG. 1, the type of the indoor units 2 is not limited to this. That is, the air-conditioning apparatus 100 may be of a ceiling concealed type, a ceiling suspended type, or any other type, as long as heating air or cooling air can be blown either directly or through ducts to the indoor space 7.

Although the outdoor unit 1 is installed in the outdoor space 6 in FIG. 1, the location of installation is not limited to this. For example, the outdoor unit 1 may be installed in a confined space, such as a machine room with ventilation openings, or may be installed inside the building 9 as long as waste heat can be discharged through an exhaust duct to the outside of the building 9. Even when the outdoor unit 1 is a water-cooled unit, the outdoor unit 1 can be installed inside the building 9. Installing the outdoor unit 1 in such a location causes no particular problems.

The heat medium relay unit 3 may be installed near the outdoor unit 1. However, it should be noted that if the distance from the heat medium relay unit 3 to the indoor units 2 is too long, the energy-saving effect will be reduced, because a considerably large amount of power is required to convey the heat medium. The number of different types of units (the outdoor unit 1, the indoor units 2, and the heat medium relay unit 3) connected to each other is not limited to that illustrated in FIG. 1, and may be determined, for example, depending on the building 9 where the air-conditioning apparatus according to Embodiment is installed.

Figure 2:
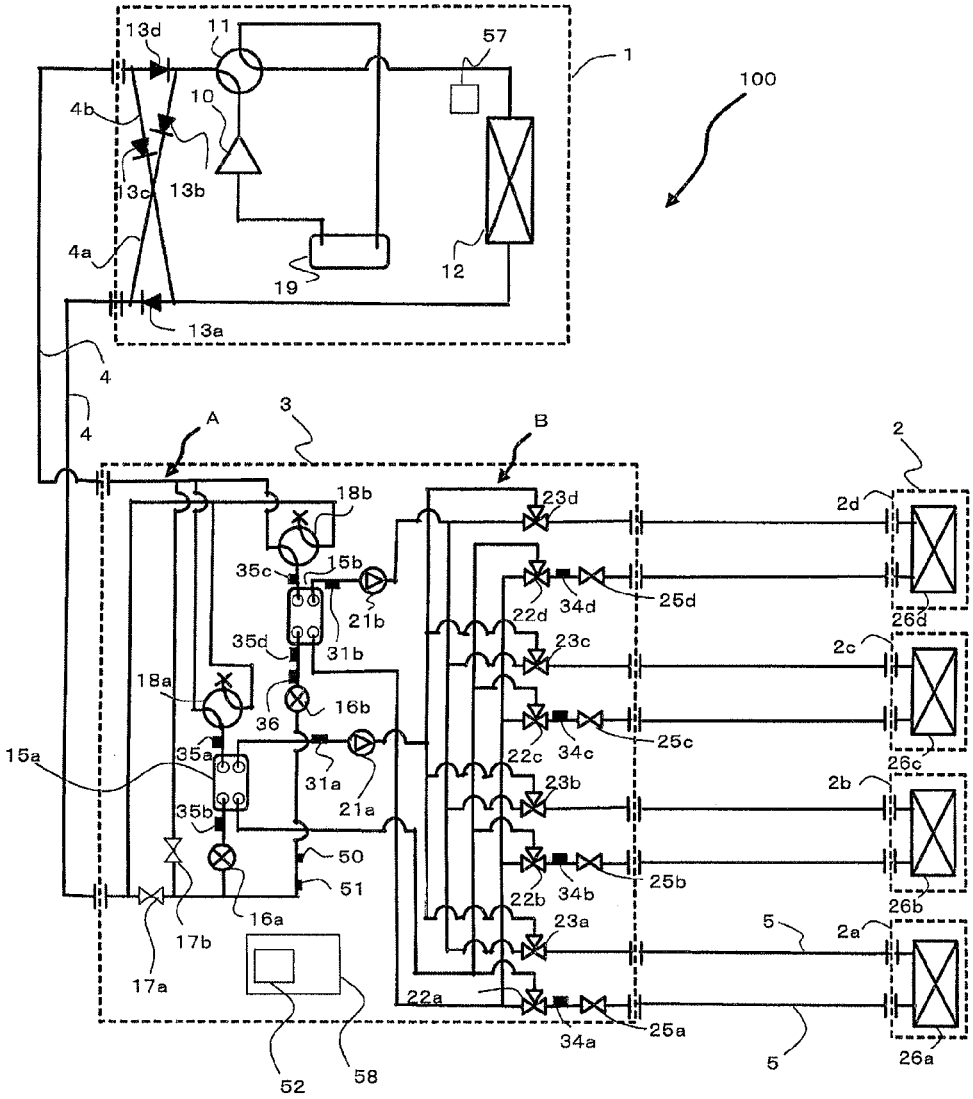
FIG. 2 is a schematic circuit configuration diagram exemplary illustrating a circuit configuration of the air-conditioning apparatus according to Embodiment of the present invention.

FIG. 2 is a schematic circuit configuration diagram exemplary illustrating a circuit configuration of the air-conditioning apparatus according to Embodiment (hereinafter referred to as an air-conditioning apparatus 100). A detailed configuration of the air-conditioning apparatus 100 will be described with reference to FIG. 2. As illustrated in FIG. 2, the outdoor unit 1 and the heat medium relay unit 3 are connected to each other by the refrigerant pipes 4 via an intermediate heat exchanger 15*a* and an intermediate heat exchanger 15*b* included in the heat medium relay unit 3. The heat medium relay unit 3 and the indoor units 2 are connected to each other by the pipes 5 also via the intermediate heat exchanger 15*a* and the intermediate heat exchanger 15*b*. The refrigerant pipes 4 and the pipes 5 will be described in detail later on.

[Outdoor Unit 1]

The outdoor unit 1 includes a compressor 10 that compresses the refrigerant, a first refrigerant flow switching device 11 formed by a four-way valve or the like, a heat-source-side heat exchanger 12 serving as an evaporator or a condenser, and an accumulator 19 that stores an excess refrigerant. These components of the outdoor unit 1 are connected to the refrigerant pipes 4.

The outdoor unit 1 is provided with a first connecting pipe 4*a*, a second connecting pipe 4*b*, a check valve 13*a*, a check valve 13*b*, a check valve 13*c*, and a check valve 13*d*. With the first connecting pipe 4*a*, the second connecting pipe 4*b*, the check valve 13*a*, the check valve 13*b*, the check valve 13*c*, and the check valve 13*d*, the flow of the heat-source-side refrigerant into the heat medium relay unit 3 can be regulated in a given direction, regardless of the operation requested by any indoor unit 2.

The compressor 10 sucks in the heat-source-side refrigerant, and compresses the heat-source-side refrigerant into a high-temperature high-pressure state. For example, the compressor 10 may be formed by a capacity-controllable inverter compressor.

The first refrigerant flow switching device 11 switches the flow of the heat-source-side refrigerant between a heating operation (a heating only operation mode and a heating main operation mode) and a cooling operation (a cooling only operation mode and a cooling main operation mode).

The heat-source-side heat exchanger 12 serves as an evaporator during heating operation, serves as a condenser during cooling operation, and exchanges heat between air supplied from an air-sending device such as a fan (not shown) and the heat-source-side refrigerant.

The accumulator 19 is disposed on the suction side of the compressor 10. The accumulator 19 stores an excess refrigerant produced by a difference between the heating operation mode and the cooling operation mode, and an excess refrigerant produced by a transitional change in operation (e.g., a change in the number of the indoor units 2 in operation) or produced depending on the load condition. In the accumulator 19, the refrigerant is separated into a liquid-phase refrigerant containing more high-boiling refrigerant and a gas-phase refrigerant containing more low-boiling refrigerant. The liquid-phase refrigerant containing more high-boiling refrigerant is stored in the accumulator 19. Therefore, when there is a liquid-phase refrigerant in the accumulator 19, more low-boiling refrigerant tends to be contained in the composition of the refrigerant circulating in the air-conditioning apparatus 100.

A controller 57 is included in the outdoor unit 1. In accordance with composition information transmitted from a controller in the heat medium relay unit 3 described below, the controller 57 controls actuation elements (actuators), such as the compressor 10 and others, included in the outdoor unit 1.

[Indoor Units 2]

Each of the indoor units 2 includes a use-side heat exchanger 26. The use-side heat exchanger 26 is connected by the pipes 5 to the corresponding heat medium flow control device 25 and the corresponding second heat medium flow switching device 23 in the heat medium relay unit 3. The use-side heat exchanger 26 exchanges heat between air supplied from an air-sending device such as a fan (not shown) and the heat medium, and generates heating air or cooling air to be supplied to the indoor space 7.

FIG. 2 illustrates an example where four indoor units 2 are connected to the heat medium relay unit 3. In FIG. 2, the indoor unit 2*a*, the indoor unit 2*b*, the indoor unit 2*c*, and the indoor unit 2*d* are arranged in this order from the bottom of the drawing. Regarding the use-side heat exchanger 26, the use-side heat exchanger 26*a*, the use-side heat exchanger 26*b*, the use-side heat exchanger 26*c*, and the use-side heat exchanger 26*d* are also arranged in this order from the bottom of the drawing, to correspond to the respective indoor units 2*a* to 2*d*. Note that the number of connected indoor units 2 is not limited to four illustrated in FIG. 2.

[Heat Medium Relay Unit 3]

The heat medium relay unit 3 includes two intermediate heat exchangers 15 for heat exchange between the refrigerant and the heat medium, two expansion devices 16 for reducing the pressure of the refrigerant, two opening and closing devices 17 for opening and closing the passages of the refrigerant pipes 4, two second refrigerant flow switching devices 18 for switching the refrigerant passages, two pumps 21 for circulating the heat medium, four first heat medium flow switching devices 22 connected to the respective pipes 5, four second heat medium flow switching devices 23 connected to the other respective pipes 5, and four heat medium flow control devices 25 connected to the respective pipes 5 to which the second heat medium flow switching devices 22 are connected.

The two intermediate heat exchangers 15 (the intermediate heat exchanger 15*a* and the intermediate heat exchanger 15*b*, hereinafter may be collectively referred to as the intermediate heat exchangers 15) each serve as a condenser (radiator) or an evaporator, exchange heat between the heat-source-side refrigerant and the heat medium, and transfer cooling energy or heating energy generated by the outdoor unit 1 and stored in the heat-source-side refrigerant to the heat medium. The intermediate heat exchanger 15*a* is disposed between an expansion device 16*a* and a second refrigerant flow switching device 18*a* in the refrigerant circuit A, and used for cooling the heat medium in a cooling and heating mixed operation mode. The intermediate heat exchanger 15*b* is disposed between an expansion device 16*b* and a second refrigerant flow switching device 18*b* in the refrigerant circuit A, and used for heating the heat medium in the cooling and heating mixed operation mode.

The two expansion devices 16 (the expansion device 16*a* and the expansion device 16*b*, hereinafter may be collectively referred to as the expansion devices 16) each serve as a pressure reducing valve or an expansion valve, and reduce the pressure of the heat-source-side refrigerant and expand it. The expansion device 16*a* is disposed upstream of the intermediate heat exchanger 15*a* in the direction in which the heat-source-side refrigerant flows in the cooling only operation mode. The expansion device 16*b* is disposed upstream of the intermediate heat exchanger 15*b* in the direction in which the heat-source-side refrigerant flows in the cooling only operation mode. The two expansion devices 16 may each be formed by a device having a variably controllable opening degree, such as an electronic expansion valve.

The two opening and closing devices 17 (the opening and closing device 17*a* and the opening and closing device 17*b*) are each formed by a two-way valve or the like, and open and close the corresponding refrigerant pipe 4. The opening and closing device 17*a* is located in the refrigerant pipe 4 on the heat-source-side refrigerant inlet side. The opening and closing device 17*b* is located in a pipe that connects the refrigerant pipes 4 on the heat-source-side refrigerant inlet and outlet sides.

The two second refrigerant flow switching devices 18 (the second refrigerant flow switching device 18*a* and the second refrigerant flow switching device 18*b*, hereinafter may be collectively referred to as the second refrigerant flow switching devices 18) are each formed by a four-way valve or the like, and switch the flow of the heat-source-side refrigerant depending on the operation mode. The second refrigerant flow switching device 18*a* is disposed downstream of the intermediate heat exchanger 15*a* in the direction in which the heat-source-side refrigerant flows in the cooling only operation mode. The second refrigerant flow switching device 18*b* is disposed downstream of the intermediate heat exchanger 15*b* in the direction in which the heat-source-side refrigerant flows in the cooling only operation mode.

The two pumps 21 (a pump 21*a* and a pump 21*b*, hereinafter may be collectively referred to as the pumps 21) circulate the heat medium conducted through the pipes 5. The pump 21*a* is provided in the pipe 5 between the intermediate heat exchanger 15*a* and the second heat medium flow switching devices 23. The pump 21*b* is provided in the pipe 5 between the intermediate heat exchanger 15*b* and the second heat medium flow switching devices 23. The two pumps 21 may be formed, for example, by capacity-controllable pumps. The pump 21*a* may be provided in the pipe 5 between the intermediate heat exchanger 15*a* and the first heat medium flow switching devices 22. The pump 21*b* may be provided in the pipe 5 between the intermediate heat exchanger 15*b* and the first heat medium flow switching devices 22.

The four first heat medium flow switching devices 22 (a first heat medium flow switching device 22*a* to a first heat medium flow switching device 22*d*, hereinafter may be collectively referred to as the first heat medium flow switching devices 22) are each formed by a three-way valve or the like, and switch the passage of the heat medium. The number of the first heat medium flow switching devices 22 is determined in accordance with the number of the indoor units 2 installed (which is four here). Each of the first heat medium flow switching devices 22 is connected at one of the three ports thereof to the intermediate heat exchanger 15*a*, connected at another one of the three ports thereof to the intermediate heat exchanger 15*b*, and connected at the remaining one of the three ports thereof to the corresponding heat medium flow control device 25. The first heat medium flow switching devices 22 are each located on the outlet side of the heat medium passage of the corresponding use-side heat exchanger 26. In the drawing, the first heat medium flow switching device 22*a*, the first heat medium flow switching device 22*b*, the first heat medium flow switching device 22*c*, and the first heat medium flow switching device 22*d* are arranged, in this order from the bottom of the drawing, to correspond to the respective indoor units 2. Note that switching the heat medium passage includes not only complete switching from one to another, but also includes partial switching from one to another.

The four second heat medium flow switching devices 23 (a second heat medium flow switching device 23*a* to a second heat medium flow switching device 23*d*, hereinafter may be collectively referred to as the second heat medium flow switching devices 23) are each formed by a three-way valve or the like, and switch the passage of the heat medium. The number of the second heat medium flow switching devices 23 is determined in accordance with the number of the indoor units 2 installed (which is four here). Each of the second heat medium flow switching devices 23 is connected at one of the three ports thereof to the intermediate heat exchanger 15*a*, connected at another one of the three ports thereof to the intermediate heat exchanger 15*b*, and connected at the remaining one of the three ports thereof to the corresponding use-side heat exchanger 26. The second heat medium flow switching devices 23 are each located on the inlet side of the heat medium passage of the corresponding use-side heat exchanger 26. In the drawing, the second heat medium flow switching device 23*a*, the second heat medium flow switching device 23*b*, the second heat medium flow switching device 23*c*, and the second heat medium flow switching device 23*d* are arranged, in this order from the bottom of the drawing, to correspond to the respective indoor units 2. Note that switching the heat medium passage includes not only complete switching from one to another, but also includes partial switching from one to another.

The four heat medium flow control devices 25 (a heat medium flow control device 25*a* to a heat medium flow control device 25*d*, hereinafter may be collectively referred to as the heat medium flow control devices 25) are each formed, for example, by a two-way valve capable of controlling the opening area thereof, and control the flow rate of the heat medium flowing in the corresponding pipe 5. The number of the heat medium flow control devices 25 is determined in accordance with the number of the indoor units 2 installed (which is four here). Each of the heat medium flow control devices 25 is connected at one end thereof to the corresponding use-side heat exchanger 26, and connected at the other end thereof to the corresponding first heat medium flow switching device 22. The heat medium flow control devices 25 are each located on the outlet side of the heat medium passage of the corresponding use-side heat exchanger 26. In the drawing, the heat medium flow control device 25*a*, the heat medium flow control device 25*b*, the heat medium flow control device 25*c*, and the heat medium flow control device 25*d* are arranged, in this order from the bottom of the drawing, to correspond to the respective indoor units 2. The heat medium flow control devices 25 may each be located on the inlet side of the heat medium passage of the corresponding use-side heat exchanger 26.

The heat medium relay unit 3 includes various detecting means (two first temperature sensors 31, four second temperature sensors 34, four third temperature sensors 35, one fourth temperature sensor 50, a first pressure sensor 36, and a second pressure sensor 51). Information detected by these detecting means (e.g., temperature information, pressure information, and concentration information of the heat-source-side refrigerant) is sent to a controller 58 that controls the overall operation of the air-conditioning apparatus 100, and used to control the driving frequency of the compressor 10, the rotation speeds of the air-sending devices (not shown) near the heat-source-side heat exchanger 12 and the use-side heat exchangers 26, the switching of the first refrigerant flow switching device 11, the driving frequencies of the pumps 21, the switching of the second refrigerant flow switching devices 18, and the switching of the heat medium passages.

The controller 58 is formed, for example, by a microcomputer. On the basis of the refrigerant composition calculated by a computing device 52 in the heat medium relay unit 3, the controller 58 calculates an evaporation temperature, a condensing temperature, a saturation temperature, a degree of superheat, and a degree of subcooling. On the basis of these calculations, the controller 58 controls the opening degrees of the expansion devices 16, the rotation speed of the compressor 10, and the speeds (including ON/OFF) of the air-sending devices for the heat-source-side heat exchanger 12 and the use-side heat exchangers 26, so as to maximize the performance of the air-conditioning apparatus 100.

Besides, on the basis of detection information from the various detecting means and instructions from a remote control, the controller 58 controls the driving frequency of the compressor 10, the rotation speeds (including ON/OFF) of the air-sending devices, the switching of the first refrigerant flow switching device 11, the drive of the pumps 21, the opening degrees of the expansion devices 16, the opening and closing of the opening and closing devices 17, the switching of the second refrigerant flow switching devices 18, the switching of the first heat medium flow switching devices 22, the switching of the second heat medium flow switching devices 23, the opening degrees of the heat medium flow control devices 25, and the like. That is, the controller 58 controls the overall operation of various devices to execute each operation mode described below.

The heat medium relay unit 3 includes the computing device 52. The computing device 52 is capable of calculating a refrigerant composition. The computing device 52 includes a ROM, which stores a physical property table that shows, for each refrigerant composition value, a correlation between a liquid enthalpy and a refrigerant temperature, a correlation between a saturated liquid enthalpy and a refrigerant temperature, and a correlation between a saturated gas enthalpy and a refrigerant temperature. The ROM also stores a physical property table that shows, for each refrigerant pressure, a correlation between a saturated liquid temperature of a refrigerant and a liquid refrigerant concentration, and a correlation between a saturated gas temperature of a refrigerant and a gas refrigerant concentration (see FIGS. 13 and 8 described below).

The physical property tables in the computing device 52 can be set, for example, after installation of the air-conditioning apparatus 100. Although the physical property tables showing the above-described correlations have been described as being stored in the ROM of the computing device 52, formulated functions instead of tables may be stored in the ROM. Refrigerant composition detection with a refrigerant composition detecting mechanism will be described in detail later on.

The controller 58 in the heat medium relay unit 3 may be either integral with or separate from the computing device 52 in the heat medium relay unit 3. When the controller 58 in the heat medium relay unit 3 also serves as the controller 57 in the outdoor unit 1, the outdoor unit 1 does not have to include the controller 57.

The two first temperature sensors 31 (a first temperature sensor 31*a* and a first temperature sensor 31*b*, hereinafter may be collectively referred to as the first temperature sensors 31) each detect the temperature of the heat medium flowing out of the corresponding intermediate heat exchanger 15, that is, the temperature of the heat medium at the outlet of the intermediate heat exchanger 15. The first temperature sensors 31 may each be formed, for example, by a thermistor. The first temperature sensor 31*a* is provided in the pipe 5 on the inlet side of the pump 21*a*. The first temperature sensor 31*b* is provided in the pipe 5 on the inlet side of the pump 21*b*.

The four second temperature sensors 34 (a second temperature sensor 34*a* to a second temperature sensor 34*d*, hereinafter may be collectively referred to as the second temperature sensors 34) are each provided between the corresponding first heat medium flow switching device 22 and the corresponding heat medium flow control device 25, and detect the temperature of the heat medium flowing out of the corresponding use-side heat exchanger 26. The second temperature sensors 34 may each be formed, for example, by a thermistor. The number of the second temperature sensors 34 is determined in accordance with the number of the indoor units 2 installed (which is four here). In the drawing, the second temperature sensor 34*a*, the second temperature sensor 34*b*, the second temperature sensor 34*c*, and the second temperature sensor 34*d* are arranged, in this order from the bottom of the drawing, to correspond to the respective indoor units 2.

The four third temperature sensors 35 (a third temperature sensor 35*a* to a third temperature sensor 35*d*, hereinafter may be collectively referred to as the third temperature sensors 35) are each provided on the inlet or outlet side of the corresponding intermediate heat exchanger 15 through which the heat-source-side refrigerant passes. The third temperature sensors 35 each detect the temperature of the heat-source-side refrigerant flowing into the corresponding intermediate heat exchanger 15 or the temperature of the heat-source-side refrigerant flowing out of the corresponding intermediate heat exchanger 15. The third temperature sensors 35 may each be formed, for example, by a thermistor. The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

The fourth temperature sensor 50 obtains temperature information used to detect a refrigerant composition. The fourth temperature sensor 50 is provided between the expansion device 16*a* and the expansion device 16*b*. The fourth temperature sensor 50 may be formed, for example, by a thermistor.

Likewise the third temperature sensor 35*d*, the first pressure sensor 36 is provided between the intermediate heat exchanger 15*b* and the expansion device 16*b*. The first pressure sensor 36 detects the pressure of the heat-source-side refrigerant flowing between the intermediate heat exchanger 15*b* and the expansion device 16*b*.

The second pressure sensor 51 obtains pressure information used to detect a refrigerant composition. The second pressure sensor 51 is provided between the expansion device 16*a* and the expansion device 16*b*.

The pipes 5 for circulating the heat medium are each connected to either the intermediate heat exchanger 15*a* or the intermediate heat exchanger 15*b*. The pipes 5 are divided into branches (four branches each here) in accordance with the number of the indoor units 2 connected to the heat medium relay unit 3. The pipes 5 are connected by the first heat medium flow switching devices 22 and the second heat medium flow switching devices 23. Controlling the first heat medium flow switching devices 22 and the second heat medium flow switching devices 23 determines whether to allow the heat medium from the intermediate heat exchanger 15*a* to flow into the use-side heat exchangers 26 and whether to allow the heat medium from the intermediate heat exchanger 15*b* to flow into the use-side heat exchangers 26.

[Refrigerant Composition Detecting Mechanism]

Various physical quantities calculated by the computing device 52 will now be described. As will be described in detail later on, the present invention has the following four operation modes: the cooling only operation mode, the cooling main operation mode, the heating main operation mode, and the heating only operation mode. Because of the resulting changes in the flow of the refrigerant, the location of the same temperature sensor switches between the upstream and downstream sides of the expansion device (the expansion device 16*a* or the expansion device 16*b*) depending on the flow of the refrigerant.

The computing device 52 can calculate a liquid enthalpy (inlet liquid enthalpy) of the refrigerant flowing into the expansion device 16*b* on the basis of a physical property table and a detection result of the fourth temperature sensor 50 that detects the temperature on the inlet side of the expansion device 16*b* (in the cooling only operation mode), or a detection result of the third temperature sensor 35*d* that detects the temperature on the outlet side of the expansion device 16*b* (in all except the cooling only operation mode).

On the basis of the physical property table and the detection result of the fourth temperature sensor 50 (in all except the cooling only operation mode) or the third temperature sensor 35*d* (in the cooling only operation mode), the computing device 52 calculates a saturated liquid enthalpy and a saturated gas enthalpy of the refrigerant flowing out of the expansion device 16*b*.

Although an exact refrigerant composition value is not yet known when the computing device 52 calculates the inlet liquid enthalpy, saturated liquid enthalpy, and saturated gas enthalpy, the computing device 52 sets a tentative refrigerant composition value and calculates those enthalpies. That is, the computing device 52 calculates the liquid enthalpy on the basis of a physical property table corresponding to the set refrigerant composition value and the detection result of the fourth temperature sensor 50 (in the cooling only operation mode) or the third temperature sensor 35*d* (in all except the cooling only operation mode), and calculates the saturated liquid enthalpy and the saturated gas enthalpy on the basis of the physical property table and the detection result of the fourth temperature sensor 50 (in all except the cooling only operation mode) or the third temperature sensor 35*d* (in the cooling only operation mode). Thus, even when an exact refrigerant composition value is not yet known, the air-conditioning apparatus 100 can calculate a refrigerant composition with high accuracy, and eliminate the need for repetitive calculations required in the related art. This will be described later on.

On the basis of the physical property table, the detection result of the fourth temperature sensor 50 (in all except the cooling only operation mode) or the third temperature sensor 35*d* (in the cooling only operation mode), and a detection result of the first pressure sensor 36 (in the cooling main operation mode) that detects the pressure on the outlet side of the expansion device 16*b* or the second pressure sensor 51 (in all except the cooling only operation mode) that detects the pressure on the inlet side of the expansion device 16*b*, the computing device 52 can calculate a concentration of the liquid refrigerant flowing out of the expansion device 16*b* and a concentration of the gas refrigerant flowing out of the expansion device 16*b*.

The computing device 52 can calculate a quality on the basis of the calculated inlet liquid enthalpy, saturated liquid enthalpy, and saturated gas enthalpy. The quality is calculated using the following Equation 1:

$$Xr=(Hin-Hls)/(Hgs-Hls) \quad \text{[Equation 1]}$$

The computing device 52 calculates a refrigerant composition on the basis of the quality, the concentration of liquid refrigerant, and the concentration of gas refrigerant. The refrigerant composition is calculated using the following Equation 2:

$$\alpha=(1-Xr)\times XR32+Xr\times YR32 \quad \text{[Equation 2]}$$

[Operation Modes]

The air-conditioning apparatus 100 includes the compressor 10, the first refrigerant flow switching device 11, the heat-source-side heat exchanger 12, the opening and closing devices 17, the second refrigerant flow switching devices 18, the refrigerant passages of the intermediate heat exchangers 15, the expansion devices 16, and the accumulator 19 that are connected by the refrigerant pipes 4 to form the refrigerant circuit A. The air-conditioning apparatus 100 also includes the heat medium passages of the intermediate heat exchangers 15, the pumps 21, the first heat medium flow switching devices 22, the heat medium flow control devices 25, the use-side heat exchangers 26, and the second heat medium flow switching devices 23 that are connected by the pipes 5 to form the heat medium circuit B. That is, a plurality of use-side heat exchangers 26 are connected in parallel to each of the intermediate heat exchangers 15 to form the heat medium circuit B composed of multiple systems.

In the air-conditioning apparatus 100, the outdoor unit 1 and the heat medium relay unit 3 are connected via the intermediate heat exchanger 15*a* and the intermediate heat exchanger 15*b* included in the heat medium relay unit 3, and the heat medium relay unit 3 and the indoor units 2 are also connected via the intermediate heat exchanger 15*a* and the intermediate heat exchanger 15*b*. That is, in the air-conditioning apparatus 100, the intermediate heat exchanger 15*a* and the intermediate heat exchanger 15*b* exchange heat between the heat-source-side refrigerant circulating in the refrigerant circuit A and the heat medium circulating the heat medium circuit B.

Each operation mode performed by the air-conditioning apparatus 100 will now be described. In accordance with an instruction from each indoor unit 2, the air-conditioning apparatus 100 performs a cooling operation or a heating operation in the indoor unit 2. That is, the air-conditioning apparatus 100 can perform either the same operation in all the indoor units 2 or a different operation in each indoor unit 2.

The operation modes performed by the air-conditioning apparatus 100 include the cooling only operation mode where all indoor units 2 in operation perform a cooling operation, the heating only operation mode where all indoor units 2 in operation perform a heating operation, the cooling main operation mode which is a cooling and heating mixed operation mode where a cooling load is greater, and the heating main operation mode which is a cooling and heating mixed operation mode where a heating load is greater. Each operation mode will now be described together with the flows of the heat-source-side refrigerant and the heat medium.

[Cooling Only Operation Mode]

Figure 3:
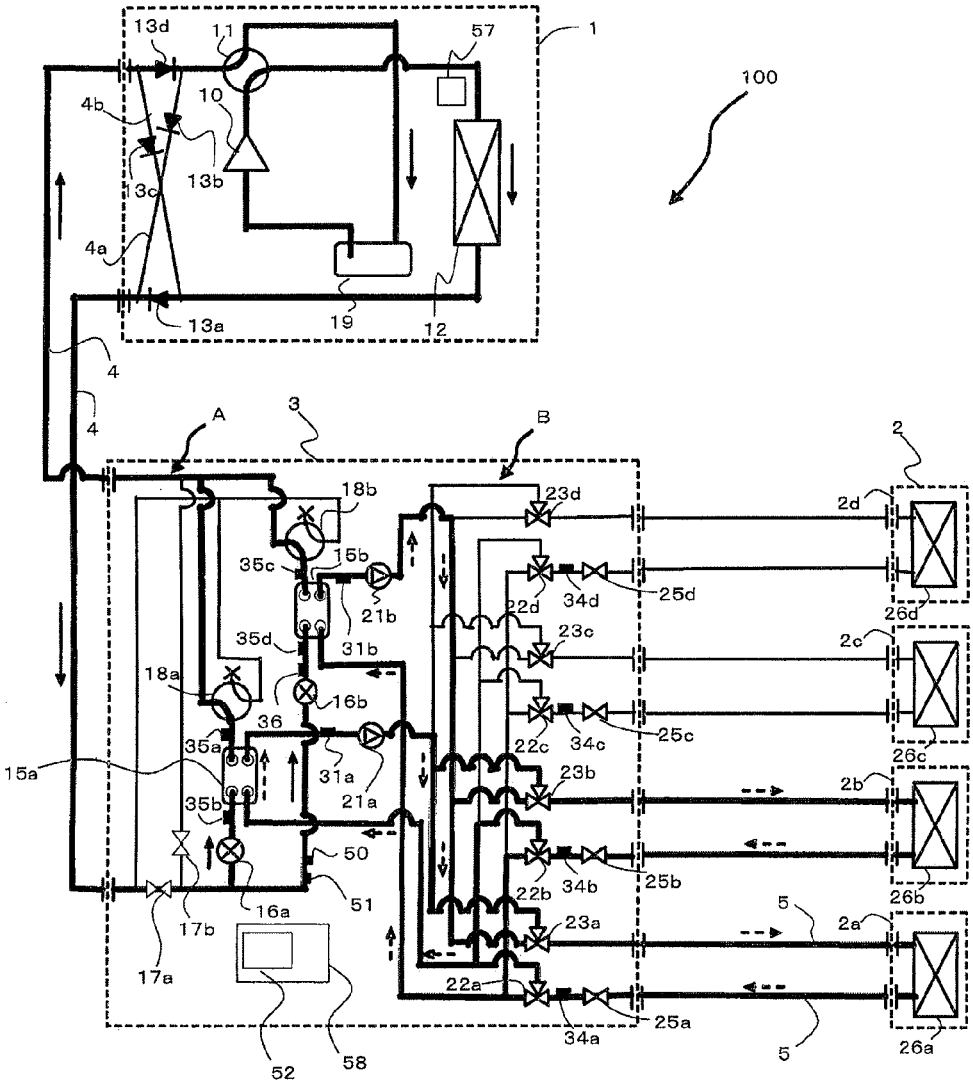
FIG. 3 is a refrigerant circuit diagram illustrating flows of refrigerants in a cooling only operation mode of the air-conditioning apparatus according to Embodiment of the present invention illustrated in FIG. 2.

FIG. 3 is a refrigerant circuit diagram illustrating flows of refrigerants in the cooling only operation mode of the air-conditioning apparatus 100 illustrated in FIG. 2. FIG. 3 illustrates the cooling only operation mode using an example where a cooling load is generated only in the use-side heat exchanger 26*a* and the use-side heat exchanger 26*b*. In FIG. 3, pipes indicated by thick lines are those through which the refrigerants (the heat-source-side refrigerant and the heat medium) flow. Also in FIG. 3, the direction of flow of the heat-source-side refrigerant is indicated by solid arrows, while the direction of flow of the heat medium is indicated by dashed arrows.

In the cooling only operation mode illustrated in FIG. 3, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11, flows into the heat-source-side heat exchanger 12, and turns into a high-pressure liquid refrigerant while transferring heat to the outdoor air at the heat-source-side heat exchanger 12. After flowing out of the heat-source-side heat exchanger 12, the high-pressure refrigerant passes through the check valve 13*a*, flows out of the outdoor unit 1, passes through the refrigerant pipe 4, and flows into the heat medium relay unit 3. After flowing into the heat medium relay unit 3 and passing through the opening and closing device 17*a*, the high-pressure refrigerant is divided and flows into the expansion device 16*a* and the expansion device 16*b*. The high-pressure refrigerant is expanded by each of the expansion device 16*a* and the expansion device 16*b* into a low-temperature low-pressure two-phase refrigerant. Note that the opening and closing device 17*b* is in a closed state.

The two-phase refrigerant flows into the intermediate heat exchanger 15*a* and the intermediate heat exchanger 15*b*, each serving as an evaporator, and turns into a low-temperature low-pressure gas refrigerant while cooling the heat medium by receiving heat from the heat medium circulating in the heat medium circuit B. The gas refrigerant flowing out of the intermediate heat exchanger 15*a* and the intermediate heat exchanger 15*b* passes through the second refrigerant flow switching device 18*a* and the second refrigerant flow switching device 18*b*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* and the second refrigerant flow switching device 18*b* communicate with low-pressure pipes. The opening degree of the expansion device 16*a* is controlled such that a degree of superheat, which is obtained as a difference between a temperature detected by the third temperature sensor 35*a* and a temperature detected by the third temperature sensor 35*b*, is constant. Similarly, the opening degree of the expansion device 16*b* is controlled such that a degree of superheat, which is obtained as a difference between a temperature detected by the third temperature sensor 35*c* and a temperature detected by the third temperature sensor 35*d*, is constant.

Next, the flow of the heat medium in the heat medium circuit B will be described.

In the cooling only operation mode, both the intermediate heat exchanger 15*a* and the intermediate heat exchanger 15*b* transfer cooling energy of the heat-source-side refrigerant to the heat medium, and the pump 21*a* and the pump 21*b* cause the cooled heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium receives heat from indoor air to cool the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to cover an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be covered by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15. The opening degrees of the first heat medium flow switching devices 22 and the second heat medium flow switching devices 23 are set to a medium level so that passages to both the intermediate heat exchanger 15*a* and the intermediate heat exchanger 15*b* are secured.

In the execution of the cooling only operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 3, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

[Heating Only Operation Mode]

Figure 4:
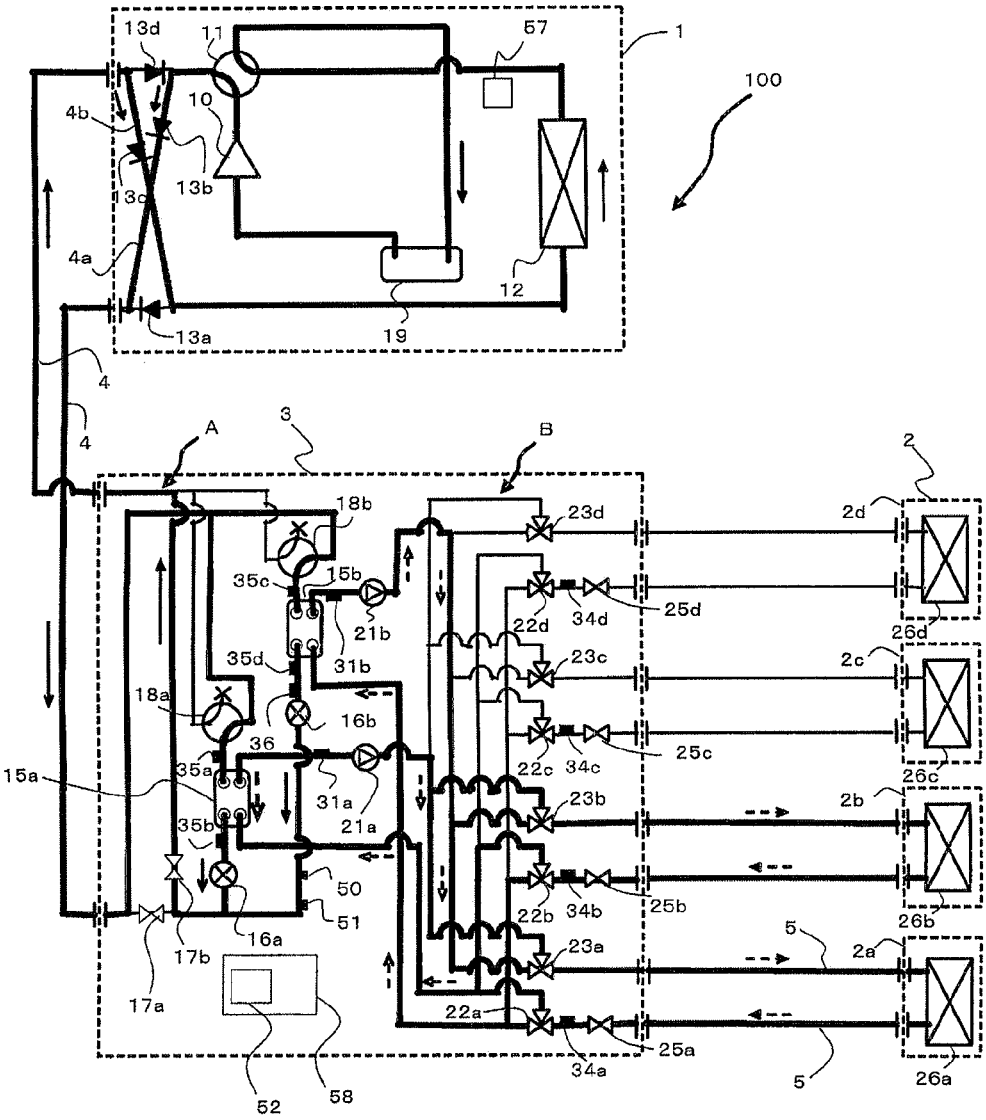
FIG. 4 is a refrigerant circuit diagram illustrating flows of refrigerants in a heating only operation mode of the air-conditioning apparatus according to Embodiment of the present invention illustrated in FIG. 2.

FIG. 4 is a refrigerant circuit diagram illustrating flows of refrigerants in the heating only operation mode of the air-conditioning apparatus 100 illustrated in FIG. 2. FIG. 4 illustrates the heating only operation mode using an example where a heating load is generated only in the use-side heat exchanger 26*a* and the use-side heat exchanger 26*b*. In FIG. 4, pipes indicated by thick lines are those through which the refrigerants (the heat-source-side refrigerant and the heat medium) flow. Also in FIG. 4, the direction of flow of the heat-source-side refrigerant is indicated by solid arrows, and the direction of flow of the heat medium is indicated by dashed arrows.

In the heating only operation mode illustrated in FIG. 4, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant is divided, passes through each of the second refrigerant flow switching device 18*a* and the second refrigerant flow switching device 18*b*, and flows into each of the intermediate heat exchanger 15*a* and the intermediate heat exchanger 15*b*.

After flowing into each of the intermediate heat exchanger 15*a* and the intermediate heat exchanger 15*b*, the high-temperature high-pressure gas refrigerant condenses and liquefies into a high-pressure liquid refrigerant while transferring heat to the heat medium circulating in the heat medium circuit B. The liquid refrigerant flowing out of the intermediate heat exchanger 15*a* and the intermediate heat exchanger 15*b* is expanded by the expansion device 16*a* and the expansion device 16*b* into a low-temperature low-pressure two-phase refrigerant. The two-phase refrigerant passes through the opening and closing device 17*b*, flows out of the heat medium relay unit 3, passes through the refrigerant pipe 4, and flows into the outdoor unit 1 again. Note that the opening and closing device 17*a* is in a closed state.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* and the second refrigerant flow switching device 18*b* communicate with high-pressure pipes. The opening degree of the expansion device 16*a* is controlled such that a degree of subcooling, which is obtained as a difference between a saturation temperature determined by converting a pressure detected by the first pressure sensor 36 and a temperature detected by the third temperature sensor 35*b*, is constant. Similarly, the opening degree of the expansion device 16*b* is controlled such that a degree of subcooling, which is obtained as a difference between a saturation temperature determined by converting a pressure detected by the first pressure sensor 36 and a temperature detected by the third temperature sensor 35*d*, is constant. Note that if a temperature at an intermediate position between the intermediate heat exchangers 15 can be measured, the temperature at the intermediate position may be used instead of using the pressure sensor 36. This can reduce the cost of producing a system.

Next, the flow of the heat medium in the heat medium circuit B will be described.

In the heating only operation mode, both the intermediate heat exchanger 15*a* and the intermediate heat exchanger 15*b* transfer heating energy of the heat-source-side refrigerant to the heat medium, and the pump 21*a* and the pump 21*b* cause the heated heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium transfers heat to the indoor air to heat the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to cover an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be covered by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15.

The opening degrees of the first heat medium flow switching devices 22 and the second heat medium flow switching devices 23 are set to a medium level so that passages to both the intermediate heat exchanger 15*a* and the intermediate heat exchanger 15*b* are secured. The use-side heat exchanger 26*a* essentially needs to be controlled in accordance with a difference between a temperature at its inlet and that at its outlet. However, since the temperature of the heat medium on the inlet side of the use-side heat exchanger 26 is substantially the same as that detected by the first temperature sensor 31*b*, using the first temperature sensor 31*b* can reduce the number of temperature sensors, so that the cost of producing the system can be reduced.

As in the case of the cooling only operation mode described above, the opening and closing of the heat medium flow control devices 25 may be controlled depending on the presence of a heat load.

[Cooling Main Operation Mode]

Figure 5:
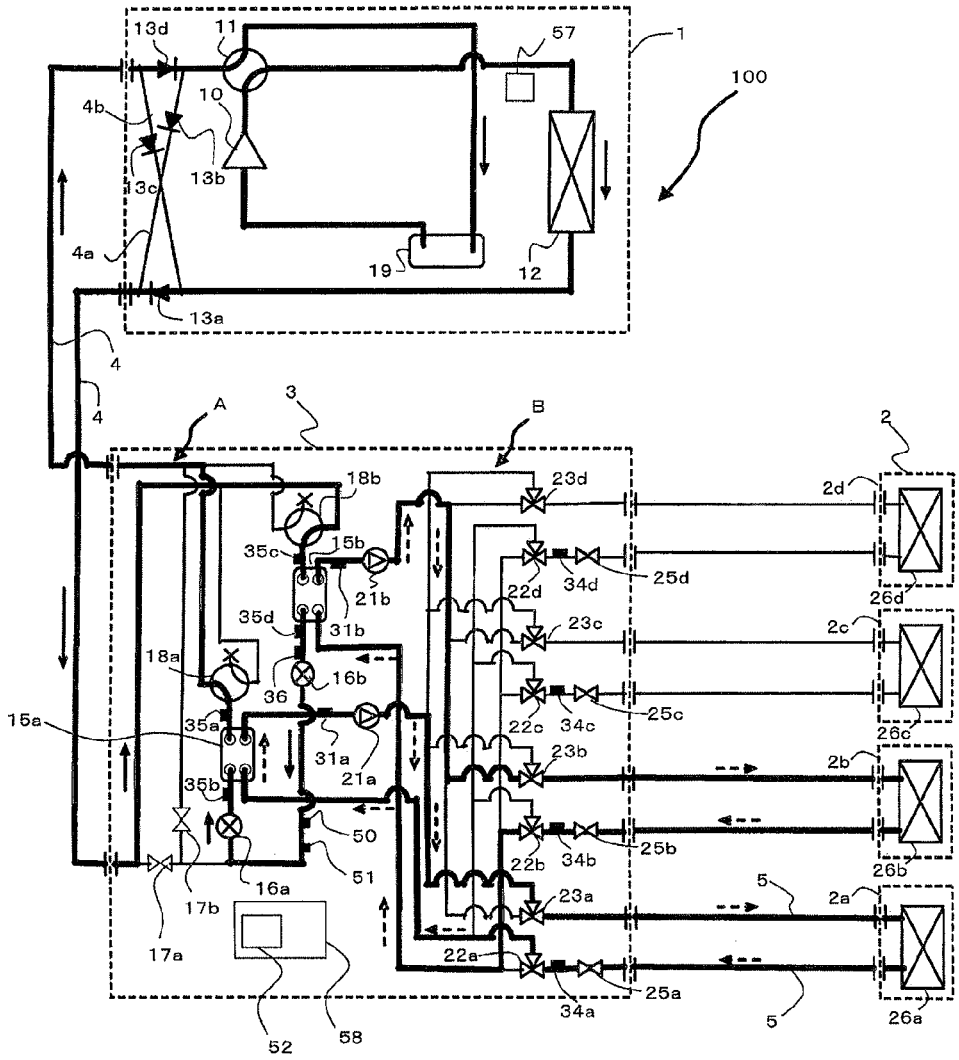
FIG. 5 is a refrigerant circuit diagram illustrating flows of refrigerants in a cooling main operation mode of the air-conditioning apparatus according to Embodiment of the present invention illustrated in FIG. 2.

FIG. 5 is a refrigerant circuit diagram illustrating flows of refrigerants in the cooling main operation mode of the air-conditioning apparatus 100 illustrated in FIG. 2. FIG. 5 illustrates the cooling main operation mode using an example where a cooling load is generated in the use-side heat exchanger 26*a* and a heating load is generated in the use-side heat exchanger 26*b*. In FIG. 5, pipes indicated by thick lines are those through which the refrigerants (the heat-source-side refrigerant and the heat medium) circulate. Also in FIG. 5, the direction of flow of the heat-source-side refrigerant is indicated by solid arrows, and the direction of flow of the heat medium is indicated by dashed arrows.

In the cooling main operation mode illustrated in FIG. 5, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*a* and between the intermediate heat exchanger 15*b* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11, flows into the heat-source-side heat exchanger 12, and turns into a liquid refrigerant while transferring heat to the outdoor air at the heat-source-side heat exchanger 12. After flowing out of the heat-source-side heat exchanger 12, the refrigerant flows out of the outdoor unit 1, passes through the check valve 13*a* and the refrigerant pipe 4, and flows into the heat medium relay unit 3. After flowing into the heat medium relay unit 3, the refrigerant passes through the second refrigerant flow switching device 18*b* and flows into the intermediate heat exchanger 15*b* serving as a condenser.

In the intermediate heat exchanger 15*b*, the refrigerant further lowers its temperature by transferring heat to the heat medium circulating in the heat medium circuit B. The refrigerant flowing out of the intermediate heat exchanger 15*b* is expanded by the expansion device 16*b* into a low-pressure two-phase refrigerant, which passes through the expansion device 16*a* and flows into the intermediate heat exchanger 15*a* serving as an evaporator. In the intermediate heat exchanger 15*a*, the low-pressure two-phase refrigerant receives heat from the heat medium circulating in the heat medium circuit B to cool the heat medium, and turns into a low-pressure gas refrigerant. The gas refrigerant flows out of the intermediate heat exchanger 15*a*, passes through the second refrigerant flow switching device 18*a*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* communicates with a low-pressure pipe, whereas the second refrigerant flow switching device 18*b* communicates with a high-pressure side pipe. The opening degree of the expansion device 16*b* is controlled such that a degree of superheat, which is obtained as a difference between a temperature detected by the third temperature sensor 35*a* and a temperature detected by the third temperature sensor 35*b*, is constant. The expansion device 16*a* is fully opened and the opening and closing device 17*a* and the opening and closing device 17*b* are closed. The opening degree of the expansion device 16*b* may be controlled such that a degree of subcooling, which is obtained as a difference between a saturation temperature determined by converting a pressure detected by the first pressure sensor 36 and a temperature detected by the third temperature sensor 35*d*, is constant. The expansion device 16*b* may be fully opened, and the degree of superheat or subcooling may be controlled with the expansion device 16*a*.

Next, the flow of the heat medium in the heat medium circuit B will be described.

In the cooling main operation mode, the intermediate heat exchanger 15*b* transfers heating energy of the heat-source-side refrigerant to the heat medium, and the pump 21*b* causes the heated heat medium to flow through the pipe 5. Also in the cooling main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium transfers heat to the indoor air to heat the indoor space 7. In the use-side heat exchanger 26*a*, the heat medium receives heat from the indoor air to cool the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to cover an air conditioning load required in the indoor space. After passing through the use-side heat exchanger 26*b* and slightly lowering its temperature, the heat medium passes through the heat medium flow control device 25*b* and the first heat medium flow switching device 22*b*, flows into the intermediate heat exchanger 15*b*, and is sucked into the pump 21*b* again. After passing through the use-side heat exchanger 26*a* and slightly increasing its temperature, the heat medium passes through the heat medium flow control device 25*a* and the first heat medium flow switching device 22*a*, flows into the intermediate heat exchanger 15*a*, and is sucked into the pump 21*a* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be covered by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the corresponding second temperature sensor 34 and a temperature detected by the first temperature sensor 31*a* such that the difference is maintained as a target value.

As in the case of the cooling only operation mode described above, the opening and closing of the heat medium flow control devices 25 may be controlled depending on the presence of a heat load.

[Heating Main Operation Mode]

Figure 6:
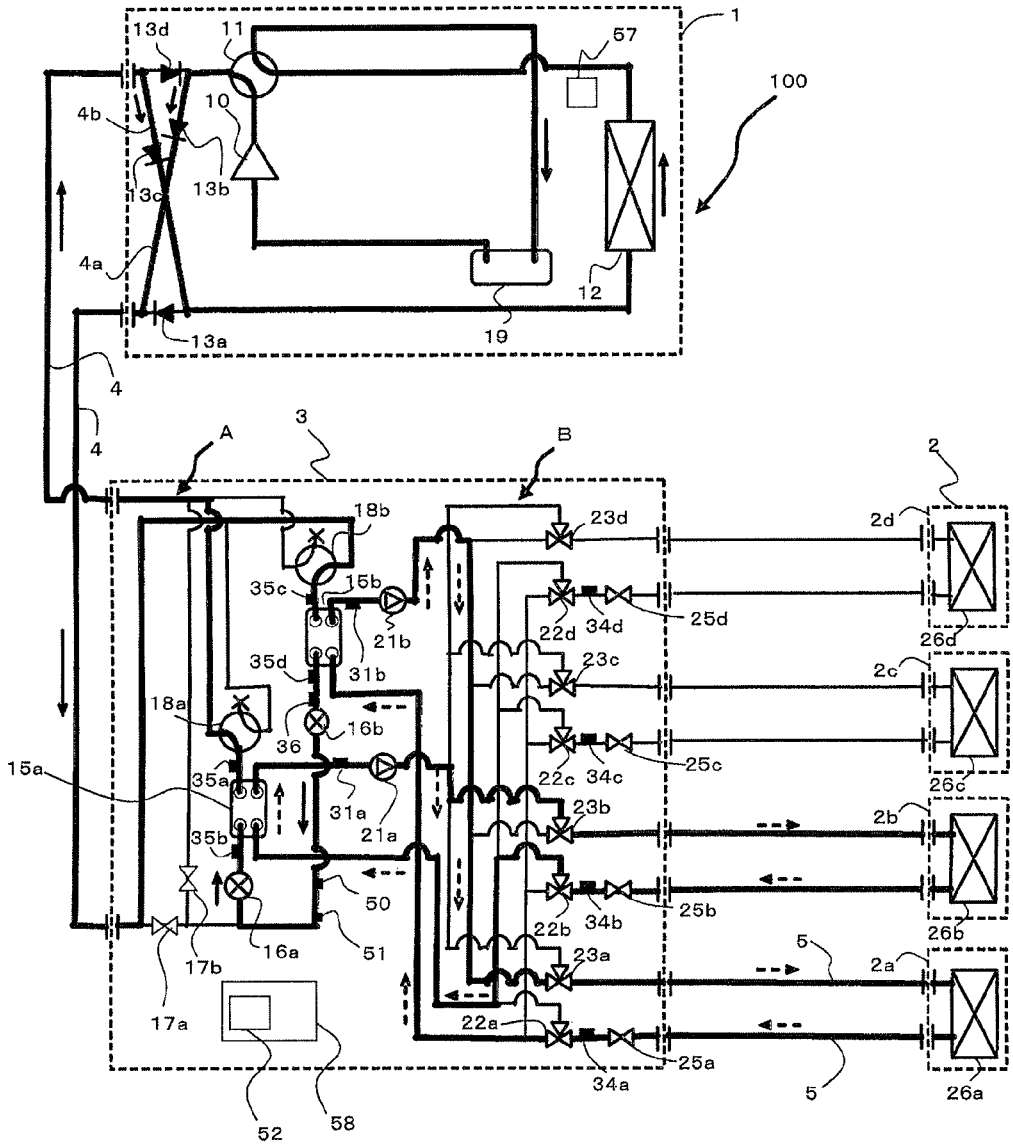
FIG. 6 is a refrigerant circuit diagram illustrating flows of refrigerants in a heating main operation mode of the air-conditioning apparatus according to Embodiment of the present invention illustrated in FIG. 2.

FIG. 6 is a refrigerant circuit diagram illustrating flows of refrigerants in the heating main operation mode of the air-conditioning apparatus 100 illustrated in FIG. 2. FIG. 6 illustrates the heating main operation mode using an example where a heating load is generated in the use-side heat exchanger 26*a* and a cooling load is generated in the use-side heat exchanger 26*b*. In FIG. 6, pipes indicated by thick lines are those through which the refrigerants (the heat-source-side refrigerant and the heat medium) circulate. Also in FIG. 6, the direction of flow of the heat-source-side refrigerant is indicated by solid arrows, and the direction of flow of the heat medium is indicated by dashed arrows.

In the heating main operation mode illustrated in FIG. 6, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*b* and between the intermediate heat exchanger 15*b* and the use-side heat exchanger 26*a*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant passes through the second refrigerant flow switching device 18*b* and flows into the intermediate heat exchanger 15*b* serving as a condenser.

In the intermediate heat exchanger 15*b*, the gas refrigerant turns into a liquid refrigerant while transferring heat to the heat medium circulating in the heat medium circuit B. The refrigerant flowing out of the intermediate heat exchanger 15*b* is expanded by the expansion device 16*b* into a low-pressure two-phase refrigerant. The low-pressure two-phase refrigerant passes through the expansion device 16*a* and flows into the intermediate heat exchanger 15*a* serving as an evaporator. In the intermediate heat exchanger 15*a*, the low-pressure two-phase refrigerant evaporates by receiving heat from the heat medium circulating in the heat medium circuit B, and cools the heat medium. The low-pressure two-phase refrigerant flows out of the intermediate heat exchanger 15*a*, passes through the second refrigerant flow switching device 18*a*, flows out of the heat medium relay unit 3, and flows into the outdoor unit 1 again.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* communicates with a low-pressure side pipe, whereas the second refrigerant flow switching device 18*b* communicates with a high-pressure side pipe. The opening degree of the expansion device 16*b* is controlled such that a degree of subcooling, which is obtained as a difference between a saturation temperature determined by converting a pressure detected by the first pressure sensor 36 and a temperature detected by the third temperature sensor 35*b*, is constant. The expansion device 16*a* is fully opened, and the opening and closing device 17*a* and the opening and closing device 17*b* are closed. The expansion device 16*b* may be fully opened, and the degree of subcooling may be controlled with the expansion device 16*a*.

Next, the flow of the heat medium in the heat medium circuit B will be described.

In the heating main operation mode, the intermediate heat exchanger 15*b* transfers heating energy of the heat-source-side refrigerant to the heat medium, and the pump 21*b* causes the heated heat medium to flow through the pipe 5. Also in the heating main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium receives heat from the indoor air to cool the indoor space 7. In the use-side heat exchanger 26*a*, the heat medium transfers heat to the indoor air to heat the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to cover an air conditioning load required in the indoor space. After passing through the use-side heat exchanger 26*b* and slightly increasing its temperature, the heat medium passes through the heat medium flow control device 25*b* and the first heat medium flow switching device 22*b*, flows into the intermediate heat exchanger 15*a*, and is sucked into the pump 21*a* again. After passing through the use-side heat exchanger 26*a* and slightly lowering its temperature, the heat medium passes through the heat medium flow control device 25*a* and the first heat medium flow switching device 22*a*, flows into the intermediate heat exchanger 15*b*, and is sucked into the pump 21*b* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be covered by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the corresponding second temperature sensor 34 and a temperature detected by the first temperature sensor 31*a* such that the difference is maintained as a target value.

As in the case of the cooling only operation mode described above, the opening and closing of the heat medium flow control devices 25 may be controlled depending on the presence of a heat load.

[Refrigerant Pipes 4]

As described above, the air-conditioning apparatus 100 according to Embodiment has several operation modes, where the heat-source-side refrigerant flows through the refrigerant pipes 4 that connect the outdoor unit 1 and the heat medium relay unit 3.

[Pipes 5]

In the several operation modes performed by the air-conditioning apparatus 100 according to Embodiment, the heat medium, such as water or antifreeze, flows through the pipes 5 that connect the heat medium relay unit 3 and the indoor units 2.

[Heat-Source-Side Refrigerant]

Embodiment has dealt with an example where a mixture of R32 and HFO1234yf is used as the heat-source-side refrigerant. Even in the case of another two-component non-azeotropic refrigerant mixture, using a control flow (described below) for calculating a refrigerant composition according to Embodiment makes it possible to calculate a circulation composition with high accuracy.

[Heat Medium]

Examples of the heat medium that can be used include brine (antifreeze), water, a mixed solution of brine and water, and a mixed solution of water and an anti-corrosive additive. Thus, in the air-conditioning apparatus 100, even if the heat medium leaks through any indoor unit 2 into the indoor space 7, since the heat medium is safe, it is possible to contribute to improved safety.

If the state (heating or cooling) of each of the intermediate heat exchanger 15*b* and the intermediate heat exchanger 15*a* changes in the cooling main operation mode and the heating main operation mode, warm water is cooled to a lower temperature and cool water is heated to a higher temperature, and this results in waste of energy. Therefore, the air-conditioning apparatus 100 is configured such that in both the cooling main operation mode and the heating main operation mode, the intermediate heat exchanger 15*b* is always on the heating side and the intermediate heat exchanger 15*a* is always on the cooling side.

When both a heating load and a cooling load are generated in the use-side heat exchangers 26, the first heat medium flow switching device 22 and the second heat medium flow switching device 23 corresponding to a use-side heat exchanger 26 in heating operation are switched to passages connected to the intermediate heat exchanger 15*b* designed for heating, and the first heat medium flow switching device 22 and the second heat medium flow switching device 23 corresponding to a use-side heat exchanger 26 in cooling operation are switched to passages connected to the intermediate heat exchanger 15*a* designed for cooling. This allows each indoor unit 2 to freely perform both the heating operation and the cooling operation.

Although the air-conditioning apparatus 100 has been described as being capable of performing a cooling and heating mixed operation, the air-conditioning apparatus 100 is not limited to this. For example, the same effect can be achieved even if the air-conditioning apparatus 100 includes one intermediate heat exchanger 15 and one expansion device 16 to which a plurality of heat medium flow control devices 25 and a plurality of use-side heat exchangers 26 are connected in parallel, so that the air-conditioning apparatus 100 can perform only one of the heating operation and the cooling operation.

The same applies to the case where only one use-side heat exchanger 26 and only one heat medium flow control device 25 are connected. The intermediate heat exchangers 15 and the expansion devices 16 may be replaced by a plurality of components having the same functions as those of the intermediate heat exchangers 15 and the expansion devices 16. Although the heat medium flow control devices 25 are included in the heat medium relay unit 3 in the example described above, the configuration is not limited to this. Each heat medium flow control device 25 may be included in the indoor unit 2, or may be configured as a unit separate from both the heat medium relay unit 3 and the indoor unit 2.

Although the heat-source-side heat exchanger 12 and each of the use-side heat exchangers 26 are each typically provided with an air-sending device which sends air to promote condensation or evaporation, the configuration is not limited to this. For example, a panel heater that uses radiation may be used as the use-side heat exchanger 26, and a water-cooled heat exchanger that transfers heat through water or antifreeze may be used as the heat-source-side heat exchanger 12. That is, the heat-source-side heat exchanger 12 and the use-side heat exchanger 26 may be of any types, as long as they are configured to be capable of transferring or receiving heat.

[Details of Refrigerant Composition Detection]

(Calculation of Refrigerant Composition)

Refrigerant composition detection performed in the air-conditioning apparatus 100 will now be described in detail. The air-conditioning apparatus 100 has four operation modes as described above. The following description will describe the cooling only operation mode as an example.

Figure 7:
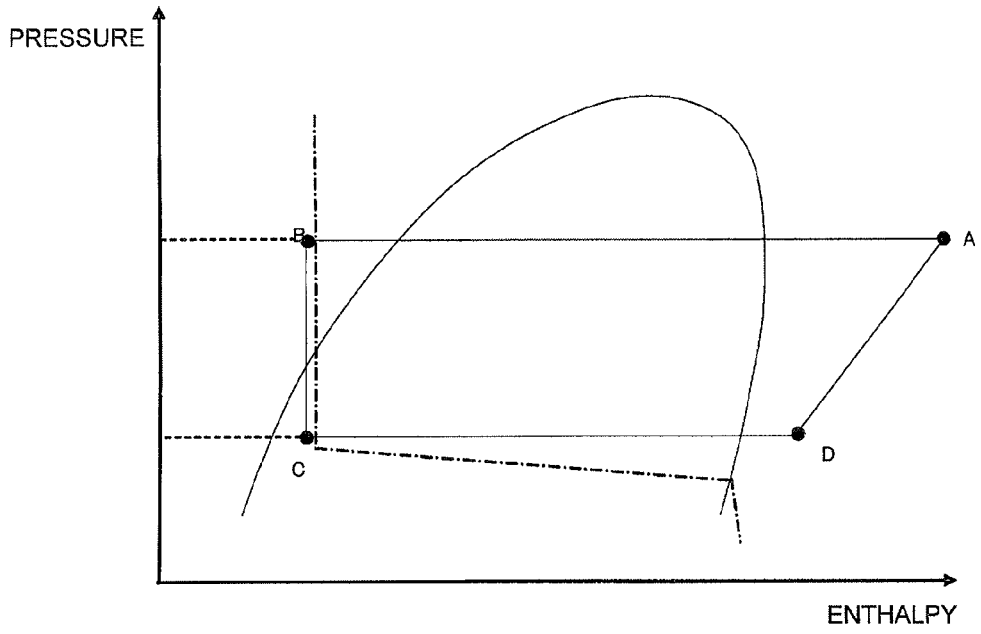
FIG. 7 is a P-H diagram showing state transition of a refrigerant in the cooling only operation mode of the air-conditioning apparatus according to Embodiment of the present invention.
Figure 8:
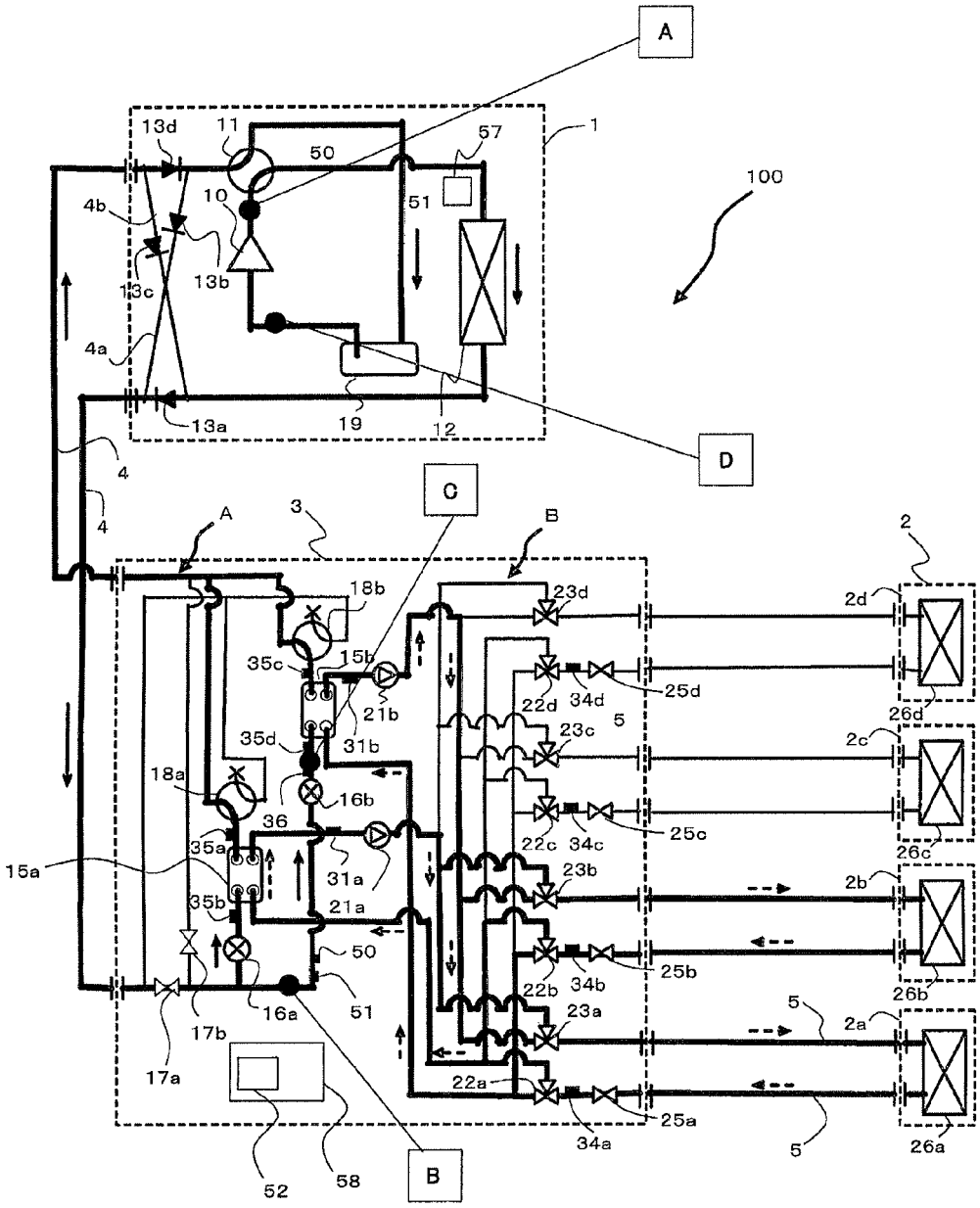
FIG. 8 is a refrigerant circuit diagram on which points corresponding to points A to D shown in FIG. 7 are plotted.
Figure 9:
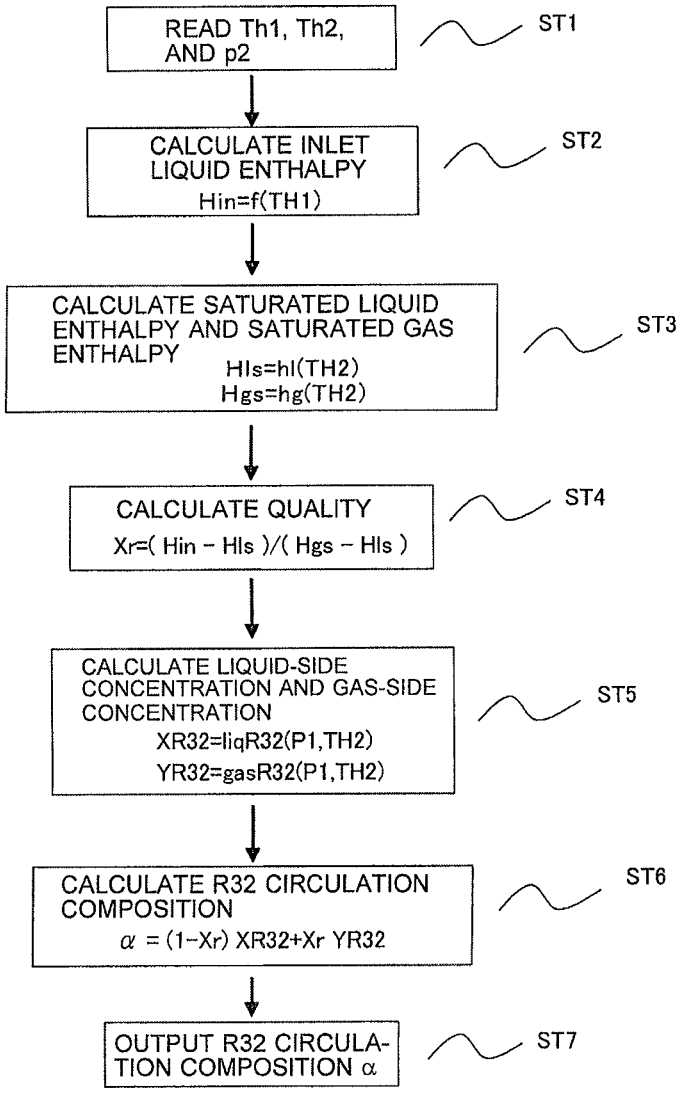
FIG. 9 is a flowchart illustrating a process of refrigerant composition detection performed in the air-conditioning apparatus according to Embodiment of the present invention.
Figure 10:
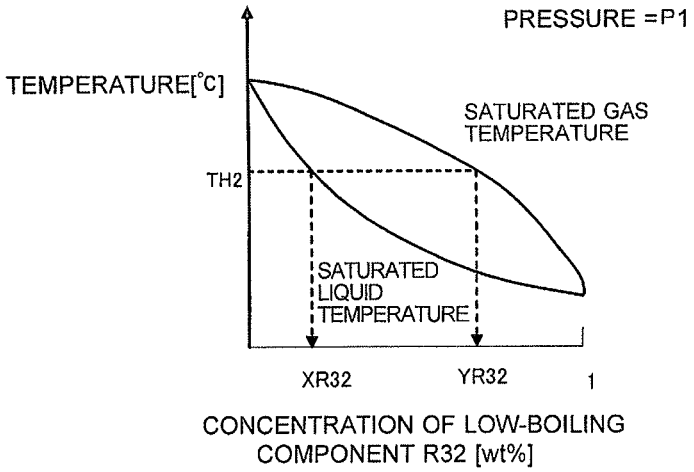
FIG. 10 is a graph showing a correlation between a saturated liquid temperature and a liquid refrigerant concentration, and a correlation between a saturated gas temperature of a refrigerant and a gas refrigerant concentration.
Figure 11:
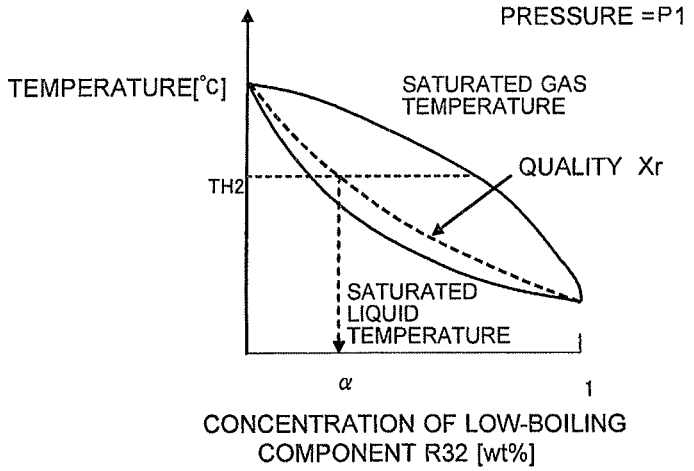
FIG. 11 is a graph showing a correlation between a quality and a refrigerant composition.

FIG. 7 is a P-H diagram showing state transition of a refrigerant in the cooling only operation mode. FIG. 8 is a refrigerant circuit diagram on which points corresponding to points A to D shown in FIG. 7 are plotted. FIG. 9 is a flowchart illustrating a process of refrigerant composition detection performed in the air-conditioning apparatus 100. FIG. 10 is a graph showing a correlation between a saturated liquid temperature and a liquid refrigerant concentration, and a correlation between a saturated gas temperature of a refrigerant and a gas refrigerant concentration. FIG. 11 is a graph showing a correlation between a quality and a refrigerant composition. Refrigerant composition detection performed by the air-conditioning apparatus 100 will be described with reference to FIGS. 7 to 11.

Note that points A to D shown in FIG. 7 are operating points on the P-H diagram and correspond to points A to D shown in FIG. 8. Point A represents a state at a discharge portion of the compressor 10, point B represents a state at a position upstream of the expansion device 16*b*, point C represents a state at a position downstream of the expansion device 16*b*, and point D represents a state at a suction portion of the compressor 10. That is, point A indicates that the refrigerant is in a high-temperature high-pressure gas state, point B indicates that the refrigerant is in a liquid state, point C indicates that the refrigerant is in a two-phase gas-liquid state, and point D indicates that the refrigerant is in a low-pressure gas state.

(Step ST1)

The computing device 52 reads a detection result of the fourth temperature sensor 50 (TH1), a detection result of the third temperature sensor 35*d* (TH2), and a detection result of the first pressure sensor 36 (P1). Then, the computing device 52 proceeds to step ST2.

(Step ST2)

The computing device 52 tentatively sets a circulating refrigerant composition value, and outputs a physical property table corresponding to the set value. On the basis of the detection result of the fourth temperature sensor 50 read in step ST1 and the physical property table, the computing device 52 calculates an enthalpy Hin (inlet liquid enthalpy) of the refrigerant flowing into the expansion device 16*b*. Then, the computing device 52 proceeds to step ST3.

In Embodiment, the set circulating refrigerant composition refers to a composition ratio of the non-azeotropic refrigerant mixture charged in the air-conditioning apparatus 100. For example, a refrigerant composition that most frequently occurs may be determined by an experiment in advance and set as the circulating refrigerant composition.

(Step ST3)

On the basis of the detection result of the third temperature sensor 35*d* read in step ST1 and the physical property table output in step ST2, the computing device 52 calculates a saturated liquid enthalpy Hs and a saturated gas enthalpy Hgs of the refrigerant flowing out of the expansion device 16*b*. Then, the computing device 52 proceeds to step ST4.

(Step ST4)

The computing device 52 calculates a quality Xr on the basis of the inlet liquid enthalpy Hin calculated in step ST2, the saturated liquid enthalpy Hs and the saturated gas enthalpy Hgs calculated in step ST3, and Equation 1 described above. Then, the computing device 52 proceeds to step ST5.

As described in step ST2, since the composition ratio of the charged non-azeotropic refrigerant mixture is used as the refrigerant composition, the calculated quality Xr is a quality Xr in the charged composition.

(Step ST5)

On the basis of the detection result of the third temperature sensor 35*d* read in step ST1, the detection result of the first pressure sensor 36 read in step ST1, and the physical property table, the computing device 52 calculates a concentration XR32 of the liquid refrigerant flowing out of the expansion device 16*b*, and a concentration YR32 of the gas refrigerant flowing out of the expansion device 16*b*. Then, the computing device 52 proceeds to step ST6.

(Step ST6)

The computing device 52 calculates a refrigerant composition a on the basis of the quality Xr calculated in step ST4, the liquid refrigerant concentration XR32 and the gas refrigerant concentration YR32 calculated in step ST5, and Equation 2 described above. Then, the computing device 52 proceeds to step ST7.

(Step ST7)

The computing device 52 outputs the refrigerant composition a calculated in step ST6 to the controller 58.

A method for calculating a liquid refrigerant concentration and a gas refrigerant concentration will be described with reference to FIG. 10, and a method for calculating a refrigerant composition will be described with reference to FIG. 11. In the following description, FIGS. 10 and 11 each may also be referred to as a concentration balance diagram.

Before description of the concentration balance diagram, a degree of freedom of a two-phase gas-liquid refrigerant flowing out of the expansion device 16*b* will be described. A degree of freedom of a refrigerant can be calculated by the following equation:

$$F=n+2-r$$

where F is a degree of freedom, n is the number of refrigerants mixed, and r is the number of phases.

Since two refrigerants are mixed in the air-conditioning apparatus 100, the degree of freedom F in a two-phase gas-liquid state can be expressed as 2+2−2=2. That is, determining two of independent variables of the refrigerant can determine the state of this system. In the air-conditioning apparatus 100, a temperature and a pressure of the two-phase gas-liquid refrigerant flowing out of the expansion device 16*b* are detected by the third temperature sensor 35*d* and the first pressure sensor 36, respectively. This can determine the state of the two-phase gas-liquid refrigerant in the refrigeration cycle. That is, it is possible to determine a liquid-phase concentration of a low-boiling refrigerant and a gas-phase concentration of the low-boiling refrigerant.

FIG. 10 actually shows that determining the detection result of the third temperature sensor 35*d* (TH2) and the detection result of the first pressure sensor 36 (P1) determines the liquid-phase concentration of the low-boiling refrigerant and the gas-phase concentration of the low-boiling refrigerant.

When the quality calculated in step ST4 is applied to the graph of FIG. 10, the quality corresponds to a dotted line in FIG. 11. That is, when the liquid-phase concentration XR32 (liquid-side concentration) and the gas-phase concentration YR32 (gas-side concentration) shown in FIG. 10 are converted using the quality to the concentration of the low-boiling refrigerant (refrigerant composition), they can be expressed as α in FIG. 11.

(Error in Calculation of Refrigerant Composition)

Figure 14:
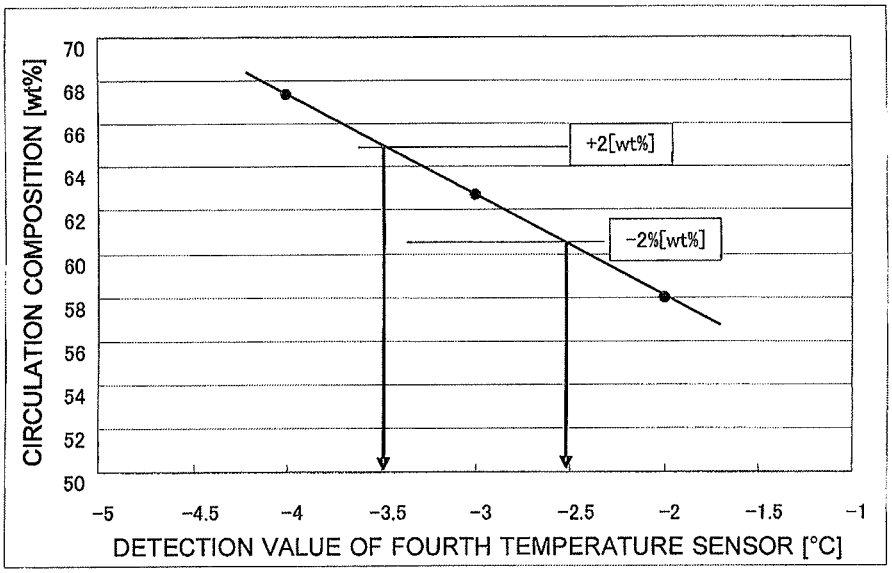
FIG. 14 is a graph for describing to what extent a detection result of a third temperature sensor gives an error to a calculated refrigerant composition.
Figure 15:
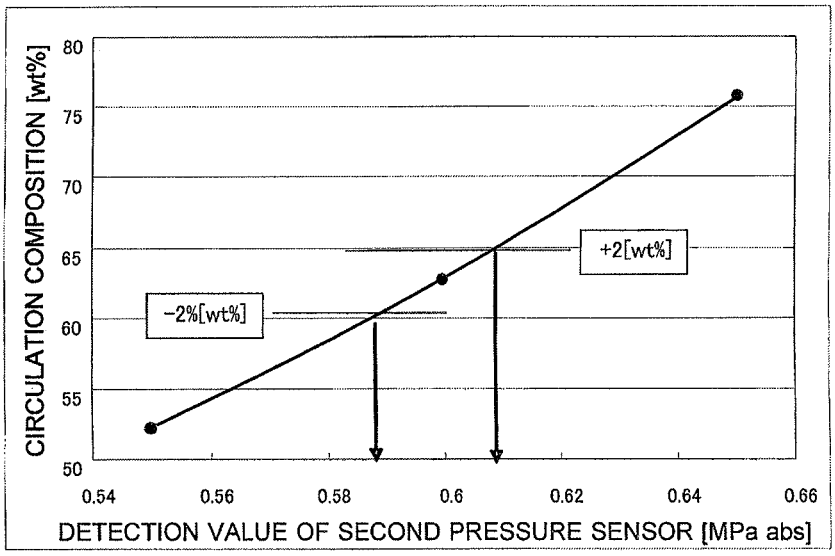
FIG. 15 is a graph for describing to what extent a detection result of a first pressure sensor gives an error to a calculated refrigerant composition.
Figure 16:
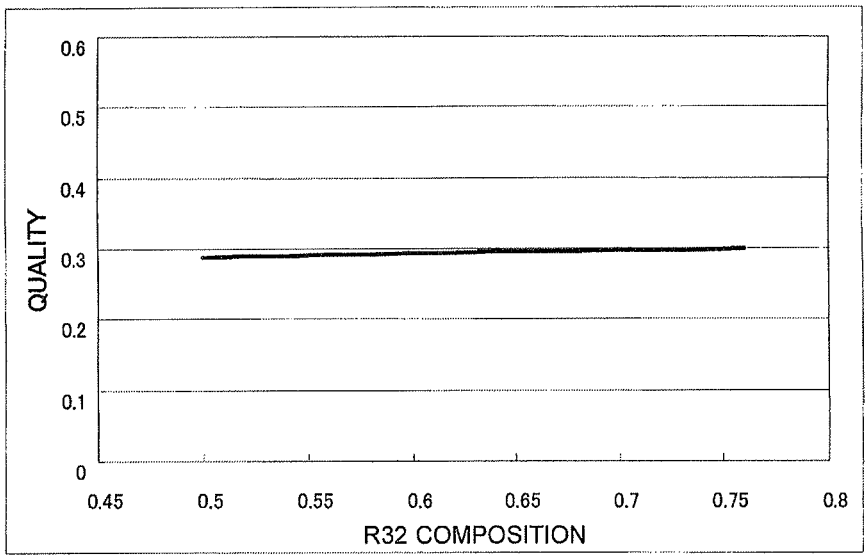
FIG. 16 illustrates a relationship between a quality and a refrigerant composition of R32.

An error in calculating a refrigerant composition in the air-conditioning apparatus 100 will now be described with reference to FIGS. 12 to 16. FIG. 12 is a table for describing to what extent a refrigerant composition set in the control flow for calculating a refrigerant composition gives an error to a calculated refrigerant composition. FIG. 13 is a table for describing to what extent various detection results in the control flow for calculating a refrigerant composition give an error to a calculated refrigerant composition. FIG. 14 is a graph for describing to what extent a detection result of the third temperature sensor 35*d* gives an error to a calculated refrigerant composition. FIG. 15 is a graph for describing to what extent a detection result of the first pressure sensor 36 gives an error to a calculated refrigerant composition. FIG. 16 illustrates a relationship between a quality and a refrigerant composition of R32.

The refrigerant composition value set in step ST2 corresponds to αb in FIG. 12. A calculated refrigerant composition corresponding to the set value αb is indicated by α. The refrigerant composition is calculated using the detection result of the fourth temperature sensor 50 (TH1)=44 (degrees C.), the detection result of the third temperature sensor 35*d* (TH2)=−3 (degrees C.), and the detection result of the first pressure sensor 36 (P1)=0.6 (MPa abs).

Data shown in FIGS. 12 and 13 is obtained when a non-azeotropic refrigerant mixture composed of R32 and R134a is used. This is because using a non-azeotropic refrigerant mixture composed of R32 and R134a provides better data accuracy. The mixture contains 66 wt % R32 and 34 wt % R134a. The physical property values are obtained from the REFPROP Version 8.0 released by the National Institute of Standards and Technology (NIST).

As shown in FIG. 12, even when the refrigerant composition αb tentatively set in step ST2 is changed significantly from 50 wt % to 74 wt %, there is little change in the calculated refrigerant composition α. This result indicates that the method that calculates the quality Xr by setting the refrigerant composition to any value in step ST2 has little effect on the refrigerant composition α eventually obtained. Therefore, without setting a refrigerant composition and performing repetitive calculations to calculate a refrigerant composition as in the conventional technique, the air-conditioning apparatus 100 can calculate a refrigerant composition with high accuracy. It is thus possible to reduce a calculation load on the computing device 52 and a load on the ROM of the computing device 52. Since the calculation load and a capacity load on the ROM can be reduced, there is no need to improve the computing speed of the computing device 52 nor the capacity. This means that the cost of the air-conditioning apparatus 100 can be reduced.

A relationship between the quality Xr and the refrigerant composition α of R32 will now be described with reference to FIG. 16. FIG. 16 shows that there is little change in the quality Xr with a change in the refrigerant composition of R32. The change in the refrigerant composition α thus has little effect on the quality Xr determined in step ST4. Therefore, even when the quality Xr determined from a tentative set value is used, the refrigerant composition α can be calculated with high accuracy.

When calculating the refrigerant composition α, the air-conditioning apparatus 100 calculates the quality Xr in step ST4 and calculates the liquid refrigerant concentration XR32 and the gas refrigerant concentration YR32 in step ST5. Then in step ST7, the air-conditioning apparatus 100 calculates the refrigerant composition from the calculated quality Xr, liquid refrigerant concentration XR32, and gas refrigerant concentration YR32. That is, the best way to estimate the refrigerant composition may be to use, through the use of the quality, the concentration balance diagram obtained from the detection result of the third temperature sensor 35*d* and the first pressure sensor 36. Therefore, the air-conditioning apparatus 100 uses this calculation method and calculates a refrigerant composition with high accuracy.

With reference to FIG. 13, an error given by the detection result of the fourth temperature sensor 50 to the calculated refrigerant composition will be described. FIG. 13 shows the detected refrigerant composition α in two ways, α (table) and α (detailed version). Specifically, a (table) provides refrigerant compositions calculated using a physical property table of the computing device 52, whereas a (detailed version) provides refrigerant compositions calculated not by using the physical property table, but by detailed analysis using the REFPROP Version 8.0. Although the table is used in Embodiment, it is found that by using either the physical property table or the REFPROP Version 8.0, substantially the same refrigerant compositions are obtained. This means that the air-conditioning apparatus 100 has good calculation accuracy.

As shown in FIG. 13, even when the temperature detected by the fourth temperature sensor 50 (TH1) changes ±1 (degree C.), the circulation composition changes only ±0.1% (see Nos. 1 to 3 in FIG. 13). This result shows that the fourth temperature sensor 50 preferably has an accuracy of ±1 (degree C.).

FIG. 14 shows that to keep an error in a calculated refrigerant composition value within, for example, about ±2 (wt %) (or about ±3% in ratio), the third temperature sensor 35*d* preferably has a detection accuracy of about ±0.5 (degrees C.).

FIG. 15 shows that to keep an error in a calculated refrigerant composition value within, for example, about ±2 (wt %) (or about ±3% in ratio), the first pressure sensor 36 preferably has a detection accuracy of about ±0.01 (MPa).

As shown in FIGS. 13 to 15, when the detection results of the fourth temperature sensor 50, the third temperature sensor 35*d*, and the first pressure sensor 36 fall within the ranges described above, the computing device 52 can calculate the refrigerant composition with high accuracy. Since this makes it possible for the controller 58 to calculate the evaporation temperature, the condensing temperature, the saturation temperature, the degree of superheat, and the degree of subcooling with high accuracy, it is possible to optimally control the opening degrees of the expansion devices 16, the rotation speed of the compressor 10, and the speeds (including ON/OFF) of the fans for the heat-source-side heat exchanger 12 and the use-side heat exchangers 26.

In the other operation modes (cooling main operation mode, heating main operation mode, and heating only operation mode), the value of the third temperature sensor 35*d* is TH1, the value of the fourth temperature sensor 50 is TH2, and the value of the second pressure sensor 51 is P1. The detection algorithm is the same as that for the control flow (ST1 to ST7 in FIG. 8) in the cooling only operation mode described above.

The refrigerant composition detection of the present method is not refrigerant composition detection that takes place in a bypass (i.e., a circuit that connects the discharge portion and the suction portion of the compressor). Therefore, the flow rate of refrigerant flowing into the intermediate heat exchanger 15*a* and the intermediate heat exchanger 15*b* is not reduced, and thus no performance degradation occurs. The refrigerant composition is estimated using the third temperature sensor 35*d*, the fourth temperature sensor 50, the first pressure sensor 36, and the second pressure sensor 51. Since these sensors are placed at locations where the flow rate of refrigerant is large, there are virtually no effects, such as changes in quality, caused by outside air temperatures and the like. The detection accuracy is thus improved significantly.

Figure 17:
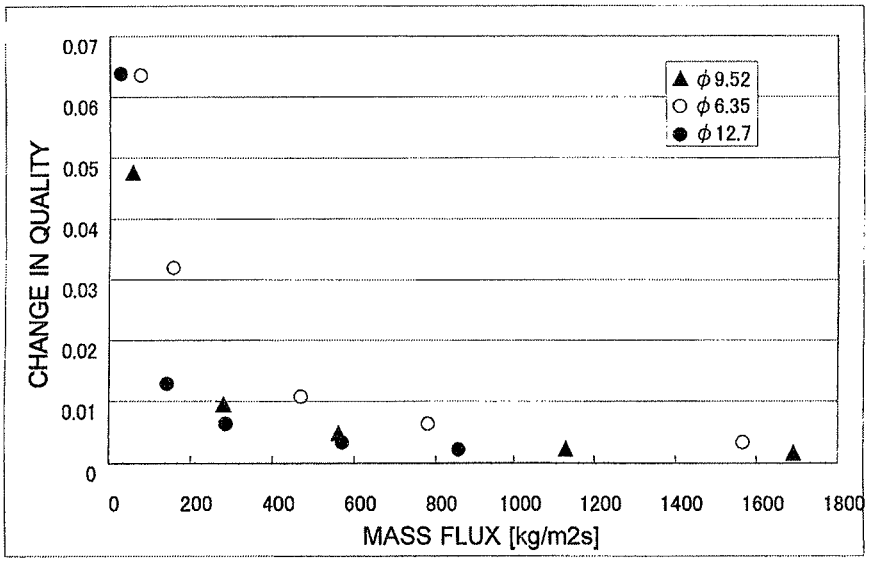
FIG. 17 is a graph showing a mass flux ($kg/m^2s$) and calculated changes in quality Xr caused by reception of heat.

FIG. 17 is a graph showing a mass flux ($kg/m^2s$) and calculated changes in quality Xr caused by reception of heat. Note that the outside air temperature is 50 degrees C., the two-phase temperature (TH2) is 0 degrees C., the pipe length is 500 (mm), the coefficient of heat transfer outside the pipe is 50 ($W/m^2K$), and the coefficient of heat transfer inside the pipe is 3000 ($W/m^2K$). "Change in quality" in the vertical axis indicates to what extent the quality is changed by the outside air. For example, assume that the quality is deviated by 0.05 by reception of heat. In this case, since the quality value is normally about 0.3, the error is as high as 0.05/0.3=0.167 (16.7%).

As can be seen from FIG. 17, the quality changes dramatically at low mass fluxes. In the refrigerant composition detection using a bypass method, it is necessary to minimize the bypass flow rate to reduce degradation of performance. For about 10 horsepower, the bypass flow rate of refrigerant is about 10 (kg/h). When the flow rate of refrigerant is 10 (kg/h:) and a bypass pipe having a diameter of 6.35 (mm) is used, the mass flux is 157 ($kg/m^2s$). In this case, the corresponding change in quality is 0.03, as shown in FIG. 17, and the error is as high as about 10%.

The third temperature sensor 35*d*, the fourth temperature sensor 50, the first pressure sensor 36, and the second pressure sensor 51 for refrigerant composition detection in the air-conditioning apparatus 100 are provided in a 12.7-diameter pipe (hereinafter, the pipe in this area will be referred to as a detecting portion pipe). The rated refrigerant flow rate is 500 (kg/h). If this refrigerant entirely flows in the detecting portion pipe, the change in quality is as small as 0.001 and an error caused by external disturbance is small. In the cooling only operation mode, where the refrigerant flows in the intermediate heat exchanger 15*a* and the intermediate heat exchanger 15*b*, the refrigerant flows into the detecting portion pipe at a flow rate of 250 (kg/h), which is half the total flow rate. The change in quality is about 0.003 and a detection error caused by external disturbance is small (an error of about 1%).

As described above, in the air-conditioning apparatus 100, the temperature sensors and the pressure sensors for refrigerant composition detection are provided in a pipe where a large amount of refrigerant flows. This can significantly improve the detection accuracy. In practice, by selecting a pipe diameter that provides a mass flux at which a change in quality is saturated in FIG. 17, an error caused by external disturbance can be reduced. Specifically, a pipe diameter that provides a mass flux of 500 ($kg/m^2s$) or more may be selected. The temperature sensors and the pressure sensors for refrigerant composition detection described above are those necessary to determine the degree of superheat or subcooling. That is, since these sensors can also be used for the purpose of refrigerant composition detection, the cost of the product can be further reduced.

The refrigerant composition is calculated by the computing device 52 in the heat medium relay unit 3, and is used to control the actuators in the heat medium relay unit 3. At the same time, the calculated refrigerant composition is transmitted to the controller 57 in the outdoor unit 1, and is used to control the actuators in the outdoor unit 1.

The first heat medium flow switching devices 22 and the second heat medium flow switching devices 23 described in Embodiment may each be of any type which is capable of switching a passage, such as a three-way valve capable of switching a three-way passage, or a combination of two on-off valves capable of opening and closing a two-way passage. A stepping-motor-driven mixing valve or the like capable of changing the flow rate in a three-way passage, or a combination of two electronic expansion valves or the like capable of changing the flow rate in a two-way passage, may be used as each of the first heat medium flow switching devices 22 and the second heat medium flow switching devices 23. In this case, it is possible to prevent water hammer caused by sudden opening or closing of the passage. Embodiment has described an example where the heat medium flow control devices 25 are each a two-way valve. However, the heat medium flow control devices 25 may each be a control valve with a three-way passage, and may each be positioned together with a bypass pipe that bypasses the corresponding use-side heat exchanger 26.

The heat medium flow control devices 25 may each be of a stepping-motor-driven type capable of controlling the flow rate in the passage, and may each be a two-way valve or a three-way valve closed at one end. The heat medium flow control devices 25 may each be an on-off valve or the like that opens and closes a two-way passage and controls an average flow rate by repeating an ON/OFF operation.

Although the second refrigerant flow switching devices 18 have been described as each being like a four-way valve, the configuration is not limited to this. The second refrigerant flow switching devices 18 may each be formed by a plurality of two-way or three-way flow switching valves and configured such that the refrigerant flows in the same manner as described above.

Although the air-conditioning apparatus 100 according to Embodiment has been described as being capable of performing a cooling and heating mixed operation, the air-conditioning apparatus 100 is not limited to this. The same effect can be achieved even if the air-conditioning apparatus 100 includes one intermediate heat exchanger 15 and one expansion device 16 to which a plurality of heat medium flow control devices 25 and a plurality of use-side heat exchangers 26 are connected in parallel, so that the air-conditioning apparatus 100 can perform only one of the heating operation and the cooling operation.

The same applies to the case where only one use-side heat exchanger 26 and only one heat medium flow control device 25 are connected. The intermediate heat exchangers 15 and the expansion devices 16 may be replaced by a plurality of components having the same functions as those of the intermediate heat exchangers 15 and the expansion devices 16. Although the heat medium flow control devices 25 are included in the heat medium relay unit 3 in the example described above, the configuration is not limited to this. Each heat medium flow control device 25 may be included in the indoor unit 2, or may be configured as a unit separate from both the heat medium relay unit 3 and the indoor unit 2.

Examples of the heat medium that can be used include brine (antifreeze), water, a mixed solution of brine and water, and a mixed solution of water and an anti-corrosive additive. Thus, in the air-conditioning apparatus 100, even if the heat medium leaks through any indoor unit 2 into the indoor space 7, since the heat medium is safe, it is possible to contribute to improved safety.

Although Embodiment has described an example where the air-conditioning apparatus 100 includes the accumulator 19, the air-conditioning apparatus 100 does not have to include the accumulator 19. Although the heat-source-side heat exchanger 12 and each of the use-side heat exchangers 26 are each typically provided with an air-sending device which sends air to promote condensation or evaporation, the configuration is not limited to this. For example, a panel heater that uses radiation may be used as the use-side heat exchanger 26, and a water-cooled heat exchanger that transfers heat through water or antifreeze may be used as the heat-source-side heat exchanger 12. That is, the heat-source-side heat exchanger 12 and the use-side heat exchanger 26 may be of any types, as long as they are configured to be capable of transferring or receiving heat.

Although Embodiment has described an example where there are four use-side heat exchangers 26, the number of the use-side heat exchangers 26 is not limited to this. Although there are two intermediate heat exchangers 15 (the intermediate heat exchanger 15*a* and the intermediate heat exchanger 15*b*) in the example described above, the number of the intermediate heat exchangers 15 is not limited to this. There may be any number of intermediate heat exchangers 15 as long as the heat medium can be cooled or/and heated. The number of the pump 21*a* and the pump 21*b* each is not limited to one. There may be a plurality of small-capacity pumps arranged in parallel and connected together.

The invention claimed is:

1. An air-conditioning apparatus comprising:

a refrigeration cycle formed by connecting, with a refrigerant pipe, a compressor, a first refrigerant flow switching device, a first heat exchanger, a refrigerant passage of a second heat exchanger that exchanges heat between a refrigerant and a heat medium, an expansion device that corresponds to the second heat exchanger, and a second refrigerant flow switching device, the refrigerant being a non-azeotropic refrigerant mixture of a low-boiling refrigerant component and a high-boiling refrigerant component;

a heat medium circuit formed by connecting, with a heat medium pipe, a heat medium passage of the second heat exchanger and a use-side heat exchanger, the heat medium circuit being configured to circulate the heat medium different from the refrigerant;

a first temperature detecting device;

a second temperature detecting device, the first temperature detecting device and the second temperature detecting device being disposed before and after the expansion device;

a first pressure detecting device;

a second pressure detecting device, the first pressure detecting device and the second pressure detecting device being disposed before and after the expansion device; and a computing device configured to calculate a composition of the refrigerant circulating in the refrigeration cycle on the basis of detection results of the first temperature detecting device, the second temperature detecting device, and the first pressure detecting device or the second pressure detecting device, wherein the computing device tentatively sets a value of a composition of the low-boiling refrigerant component of the refrigerant circulating in the refrigeration cycle within a range of 50 to 74 wt % and outputs a physical property table corresponding to the set value, calculates a quality of the refrigerant flowing out of the expansion device on the basis of an inlet liquid enthalpy calculated on the basis of the physical property table and a temperature from the first temperature detecting device, and a saturated gas enthalpy and a saturated liquid enthalpy calculated on the basis of the physical property table and temperature information from the second temperature detecting device, calculates a liquid-phase concentration and a gas-phase concentration of the refrigerant flowing out of the expansion device on the basis of a temperature and a pressure of the refrigerant flowing out of the expansion device, and calculates a further value of the composition of the low-boiling refrigerant component of the refrigerant circulating in the refrigeration cycle on the basis of the quality calculated from the tentatively set value of the composition of the low-boiling refrigerant component of the refrigerant circulating in the refrigeration cycle, the liquid-phase concentration, and the gas-phase concentration.

2. The air-conditioning apparatus of claim 1, wherein the expansion device comprises a plurality of expansion devices, and before and after one of the plurality of the expansion devices, the first temperature detecting device, the second temperature detecting device, the first pressure detecting device, and the second pressure detecting device are disposed, and wherein the air-conditioning apparatus further comprises, an outdoor unit including the compressor, the first refrigerant flow switching device, and the first heat exchanger, a heat medium relay unit including the second heat exchanger, the plurality of expansion devices, a plurality of second refrigerant flow switching devices, and the computing device, and at least one indoor unit including the use-side heat exchanger.

3. The air-conditioning apparatus of claim 2, wherein the first temperature detecting device, the second temperature detecting device, the first pressure detecting device, and the second pressure detecting device are disposed inside the heat medium relay unit.

4. The air-conditioning apparatus of claim 1, wherein a diameter of the refrigerant pipe provided with the first temperature detecting device, the second temperature detecting device, the first pressure detecting device, and the second pressure detecting device is selected such that a mass flux is 500 ($kg/m^2s$) or more.

5. The air-conditioning apparatus of claim 1, wherein the computing device calculates the inlet liquid enthalpy on the basis of the tentatively set value of the composition of the low-boiling refrigerant component of the refrigerant circulating in the refrigeration cycle and a temperature of the refrigerant flowing into the expansion device in the refrigerant pipe provided with the first temperature detecting device, the second temperature detecting device, the first pressure detecting device, and the second pressure detecting device.

6. The air-conditioning apparatus of claim 1, wherein the computing device calculates the quality from the tentatively set value of the composition of the low-boiling refrigerant component of the refrigerant circulating in the refrigeration cycle, the inlet liquid enthalpy calculated on the basis of a temperature of the refrigerant flowing into the expansion device in the refrigerant pipe provided with the first temperature detecting device, the second temperature detecting device, the first pressure detecting device, and the second pressure detecting device, and a saturated gas enthalpy and a saturated liquid enthalpy calculated from a temperature of the refrigerant flowing out of the expansion device.

7. The air-conditioning apparatus of claim 1, wherein the first temperature detecting device and the second temperature detecting device are configured such that an accuracy of refrigerant temperature detection is within ±0.5 degrees C.

8. The air-conditioning apparatus of claim 1, wherein the first pressure detecting device and the second pressure detecting device are configured such that an accuracy of refrigerant pressure detection is within ±0.01 MPa.

9. The air-conditioning apparatus of claim 1, wherein a refrigerant mixture of R32 and HFO1234yf or a refrigerant mixture of R32 and HFO1234ze is used as the refrigerant.

* * * * *